US008985411B2

(12) United States Patent
Mongan et al.

(10) Patent No.: US 8,985,411 B2
(45) Date of Patent: Mar. 24, 2015

(54) DUTY BELT SYSTEM

(76) Inventors: Ryan Mongan, Orange, CA (US); Juan Sadder, Seattle, WA (US); David Law, Seattle, WA (US); Graeme Esarey, Seattle, WA (US); Scott Comins, Seattle, WA (US)

( * ) Notice: Subject to any disclaimer, the term of this patent is extended or adjusted under 35 U.S.C. 154(b) by 251 days.

(21) Appl. No.: 13/350,803

(22) Filed: Jan. 15, 2012

(65) Prior Publication Data

US 2012/0132682 A1 May 31, 2012

Related U.S. Application Data

(63) Continuation-in-part of application No. 13/154,284, filed on Jun. 6, 2011, now Pat. No. 8,510,868.

(60) Provisional application No. 61/396,927, filed on Jun. 7, 2010, provisional application No. 61/457,152, filed on Jan. 18, 2011.

(51) Int. Cl.
*A45F 5/02* (2006.01)

(52) U.S. Cl.
CPC ..... *A45F 5/021* (2013.01); *Y10S 224/914* (2013.01)
USPC ..... 224/195; 224/914; 224/667

(58) Field of Classification Search
CPC ..... A45F 5/021; F41C 33/046
USPC ..... 224/101, 195, 660, 662–667, 673, 914, 224/669–672, 269, 271–272; 2/300, 2/310–312, 319–322, 338; 248/221.11
See application file for complete search history.

(56) References Cited

U.S. PATENT DOCUMENTS

| | | | | |
|---|---|---|---|---|
| 3,004,519 | A * | 10/1961 | Weissman | 119/857 |
| 4,782,535 | A | 11/1988 | Yewer, Jr. et al. | |
| 5,683,022 | A * | 11/1997 | Evans | 224/583 |
| 5,758,366 | A | 6/1998 | Wilson | |
| 6,286,736 | B1 | 9/2001 | Angus et al. | |
| 6,769,586 | B1 | 8/2004 | Beletsky et al. | |
| 6,837,188 | B1 * | 1/2005 | Martin | 119/792 |
| 7,762,440 | B2 | 7/2010 | Cook | |
| 7,950,554 | B2 * | 5/2011 | Hoffner et al. | 224/661 |
| 2003/0088901 | A1 * | 5/2003 | Batters et al. | 2/46 |
| 2003/0110550 | A1 * | 6/2003 | Guibord | 2/312 |
| 2004/0065709 | A1 * | 4/2004 | Dillenberger | 224/682 |
| 2004/0226972 | A1 * | 11/2004 | Cook | 224/195 |
| 2006/0175370 | A1 * | 8/2006 | Arney et al. | 224/666 |
| 2007/0033698 | A1 | 2/2007 | Long | |
| 2009/0001117 | A1 * | 1/2009 | Rassias | 224/673 |
| 2009/0114693 | A1 * | 5/2009 | Rassias | 224/663 |
| 2010/0154269 | A1 | 6/2010 | Escalante, III | |
| 2010/0314423 | A1 | 12/2010 | Kawamoto et al. | |

* cited by examiner

*Primary Examiner* — Justin Larson
*Assistant Examiner* — Phillip Schmidt
(74) *Attorney, Agent, or Firm* — Maxvalve IP LLC

(57) ABSTRACT

One example of the invention describes a belt that is to be used by uniformed professional field personnel (e.g. law enforcement, fire, park department, search and rescue, private security, utilities personnel, military, etc.). Some examples of the invention introduce many new features which allow for improved access, comfort, reliability, ruggedness and cosmetics. In one embodiment, the description describes a metal rail on a belt, to which accessories attach. The other items of the inventions are the details of the buckle and its various designs. Other attachments and accessories, plus various setups and arrangements for the belts and buckles, are also presented here. For example, the elastomeric belt variation helps the user, when sitting, with the belt on.

20 Claims, 32 Drawing Sheets

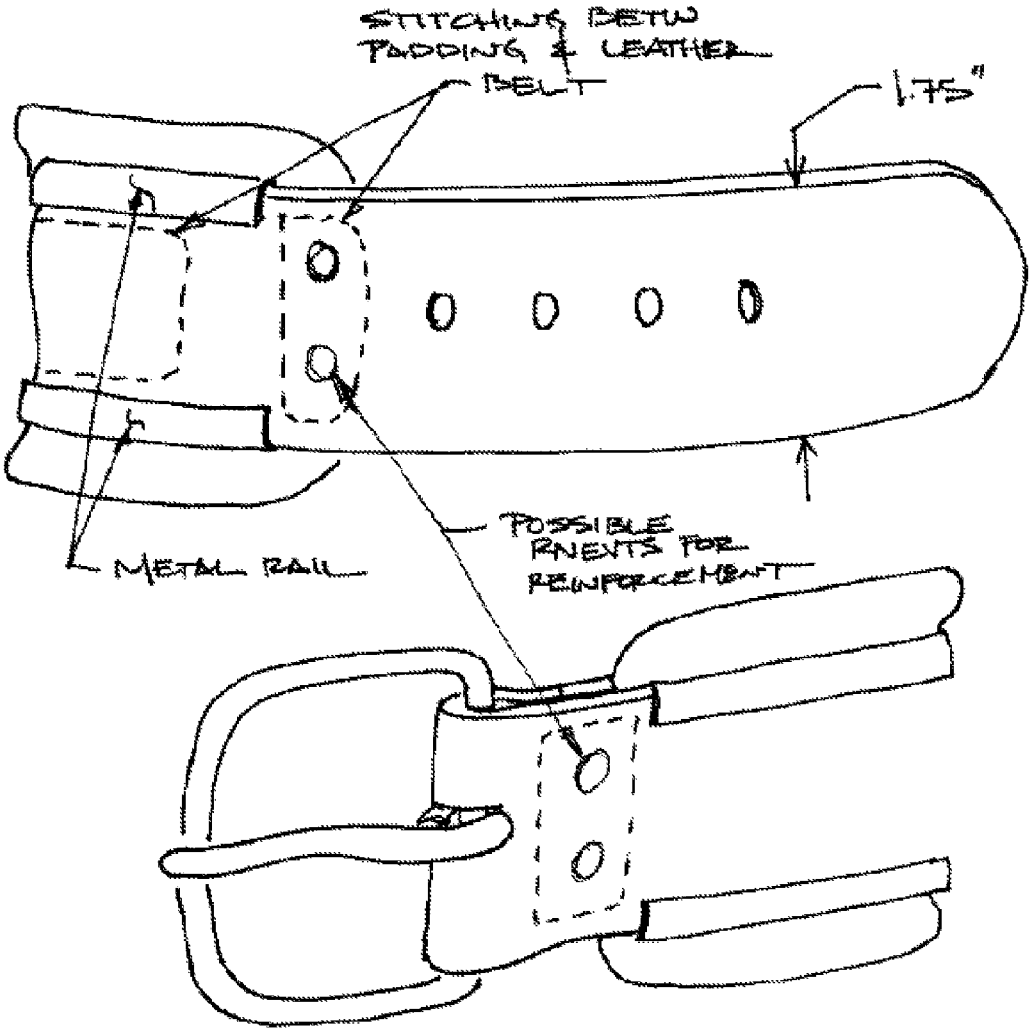
Figure 13. Cosmetic piece is extended to form traditional belt ends.

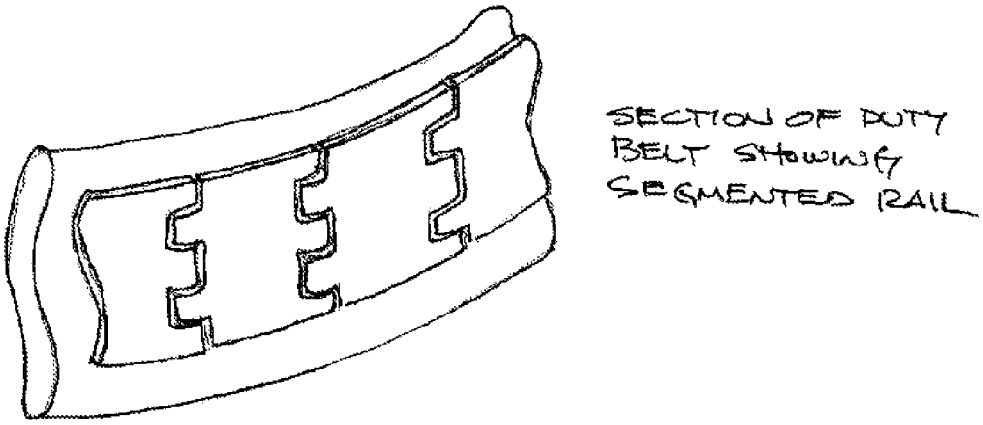

Figure 14. Segmented rail.

RAIL CAN BE PRE-FORMED INTO SHAPE
PRIOR TO ASSEMBLY

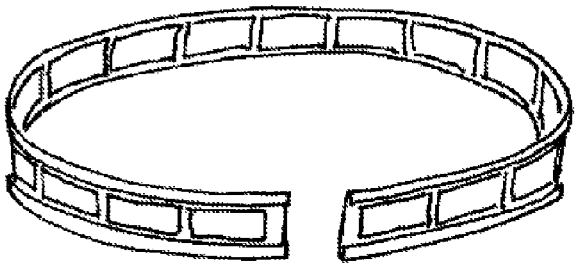

- WITHOUT THIS THE RAIL MIGHT HAVE A TENDENCY TO KINK WHEN PUTTING IT ON
- ALLOWS / DEMANDS UNIQUE POP DISPLAY WHICH SEPARATES IT FROM OTHER BELTS
- ALLOWS FOR MARKETING DISTINCTIONS — "PEOPLE AREN'T FLAT — BELTS SHOULDN'T BE."
- FIRST STEP IN A PLATFORM WHERE THE RAIL IS ANGLED AS YOU MOVE AROUND THE BODY

Figure 15. Pre-formed rail.

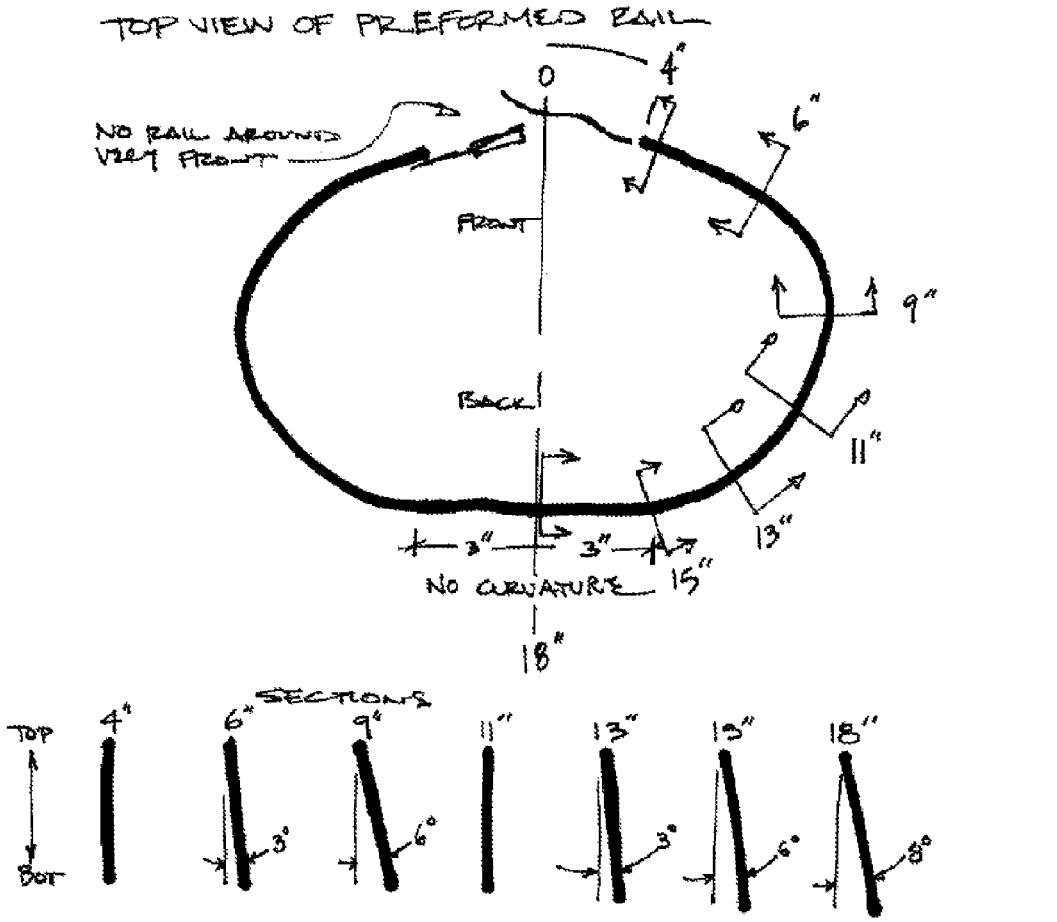
THE BOTTOM OF THE RAIL FLARES OUT TO MATCH BODY CONTOURS. THESE NUMBERS WERE TAKEN OFF ME.
THE PADDING COULD ALSO CHANGE AS YOU TRAVEL AROUND THE BODY. ← IN ORDER TO SPREAD OUT THE HOT SPOTS (PELVIC BONES).
Figure 16. Pre-formed rail with a variety of curvatures and flaring.

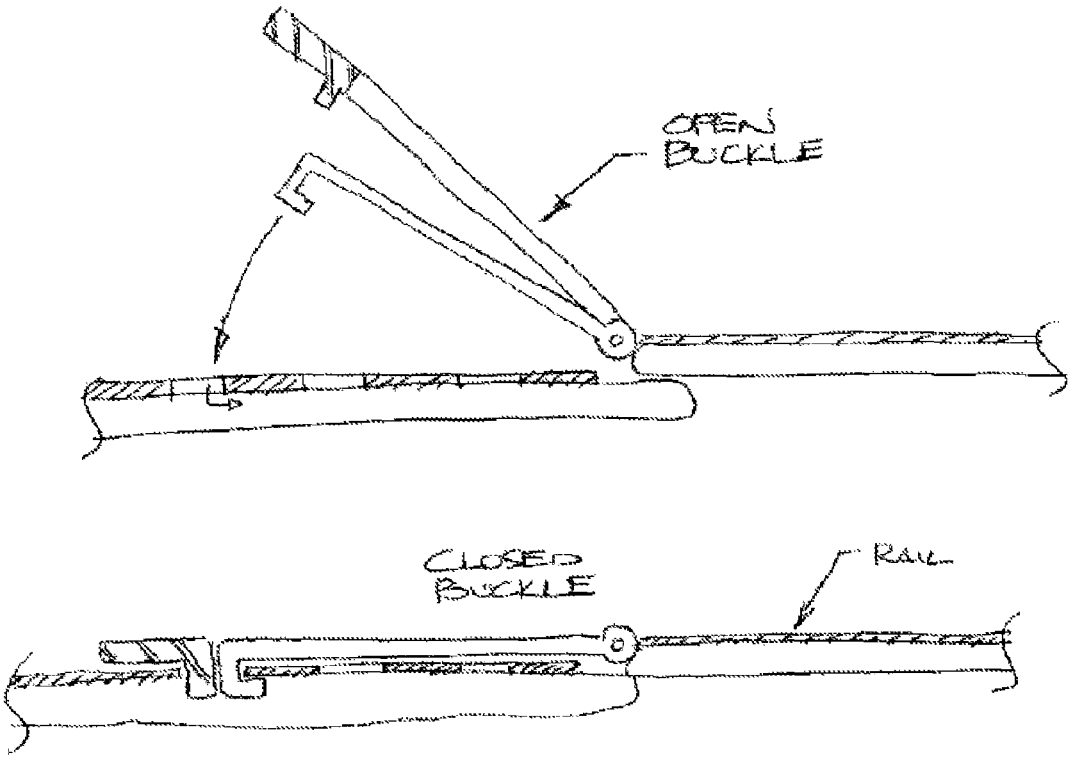
Figure 17b. Alternative buckle in open and closed position (cross section from above)

DUTY BELT SYSTEM

RELATED APPLICATIONS

The current application is related to and CIP (continuation in part) of a prior co-pending application by the same title, filed Jun. 6, 2011, Ser. No. 13/154,284. The current application is taking benefits of all teachings and earlier filing date of that application, and incorporating all its teaching entirely by reference.

Ser. No. 13/154,284 was in turn related and continuation of a prior provisional application Ser. No. 61/396,927, filed on Jun. 7, 2010, with similar title, taking benefits of all teachings and earlier filing date of that application, and incorporating all its teaching entirely by reference.

Ser. No. 13/154,284 was also related to a prior provisional application Ser. No. 61/457,152, filed on Jan. 18, 2011, with similar title, taking benefits of all teachings and earlier filing date of that application, and incorporating all its teaching entirely by reference.

BACKGROUND OF THE INVENTION

There is a need for better gear for law enforcement. The convenience, weight, security, stability, longevity, flexibility, and versatility are some of the factors that can be improved for the operation of the law enforcement officers, which are mission critical.

Duty Belts, as they are known in the industry, have been available for some time. The most common configuration is the following: The user has an inner belt (also known as a trouser belt) that is threaded through the belt loops of the user's pants (FIG. 1). Commonly, these do not incorporate a buckle in order to keep the profile as thin as possible. They also usually have one half of a Velcro assembly on the outward facing surface. Outside of the inner belt is the duty belt (also known as a Sam Browne belt by US law enforcement) itself (FIG. 2). This is a wider belt (typically 2" or 2.25" wide) and lies across the inner belt outboard of the pant belt loops. The duty belt is secured to the user by means of the other half of the Velcro assembly facing inwards toward the inner belt.

Sometimes, supplemental mechanical straps, known as "keepers", are used that wrap around both inner and duty belts to ensure that they are firmly attached to one another (FIG. 3). Still on other belts, there is no Velcro used at all between the inner and the duty belt. The keepers are the sole retention mechanism between the two belts in that configuration.

Some prior art references are, which are all different from our teachings below:

- U.S. Pat. No. 7,594,305, by Moore, teaching "Socket engaging tether for electronic devices"
- U.S. Pat. No. 5,709,013, by Stanback, teaching "Ornament support device"
- U.S. application Ser. No. 11/351,167 or 2007/0075914, by Bates, teaching "security antenna".

SUMMARY OF THE INVENTION

One embodiment of the invention describes a belt that is to be used by uniformed professional field personnel (e.g. law enforcement, fire, park department, search and rescue, private security, utilities personnel, military, etc.). One embodiment of the invention introduces many new features which allow for improved access, comfort, reliability, ruggedness and cosmetics.

It is important that the duty belt does not become separated inadvertently. All of the field professional's gear is attached to this belt. In the case of law enforcement this includes the officer's sidearm holster. The weight of some of these assemblies can exceed 20 pounds. If the belt were to come detached inadvertently, devices could become damaged. More critical to this is the danger of the law enforcement officer becoming separated from his or her sidearm or handcuffs during a physical altercation with a suspect. Care is taken with the duty belt buckle in order to minimize this risk. The duty belt buckles are executed in several different ways, each with their own pros and cons.

In the first set of embodiments, we have at least two distinct classes of inventions described here. In one embodiment, the description describes a metal rail on a belt, to which accessories attach. This is one of the main inventions. The other items of the inventions are the details of the buckle and its various designs (presented here). Other attachments and accessories, plus various setups and arrangements for the belts and buckles are also presented here.

For example, the elastomeric belt variation helps the user, when sitting, with the belt on.

BRIEF DESCRIPTION OF THE DRAWINGS

Some examples and embodiments are described here for clarification, but the inventions are not limited to these examples:

FIG. 13 shows a cosmetic piece is extended, to form traditional belt ends.

FIG. 14 shows a segmented rail.

FIG. 15 shows a pre-formed rail.

FIG. 16 shows a pre-formed rail with a variety of curvatures and flaring.

FIG. 17*b* shows an alternative buckle in open and closed position (cross section from above), as an embodiment of the invention.

DETAILED DESCRIPTION OF THE PREFERRED EMBODIMENTS

Figure 1:
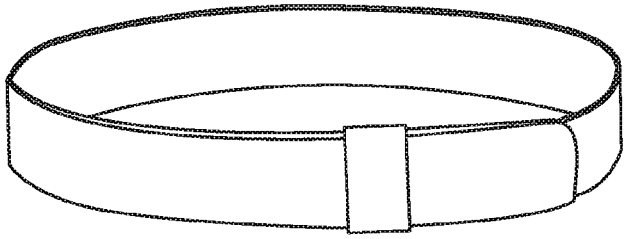
FIG. 1 shows a typical inner belt.
Figure 2:
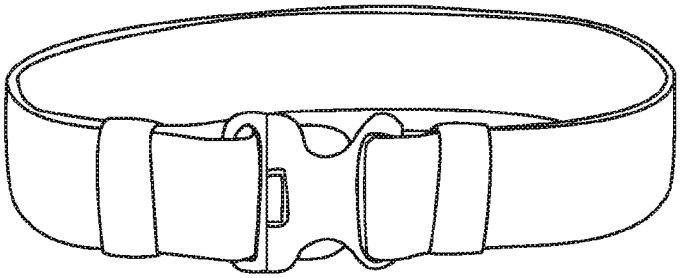
FIG. 2 shows a typical duty belt.
Figure 3:
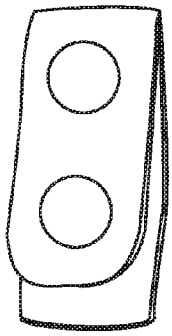
FIG. 3 shows typical keepers.
Figure 4A:
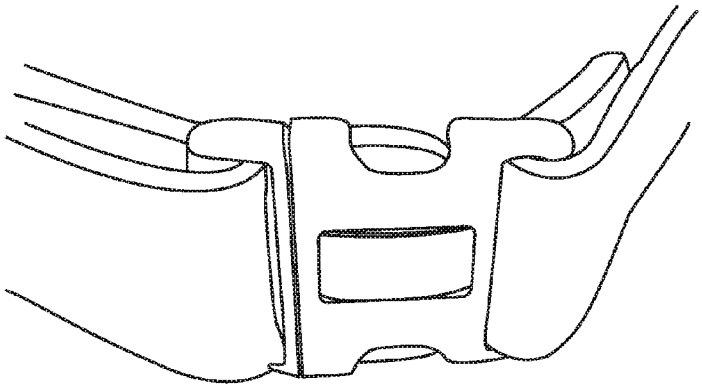
FIG. 4*a* shows a typical Fastex buckle duty belt.
Figure 4B:
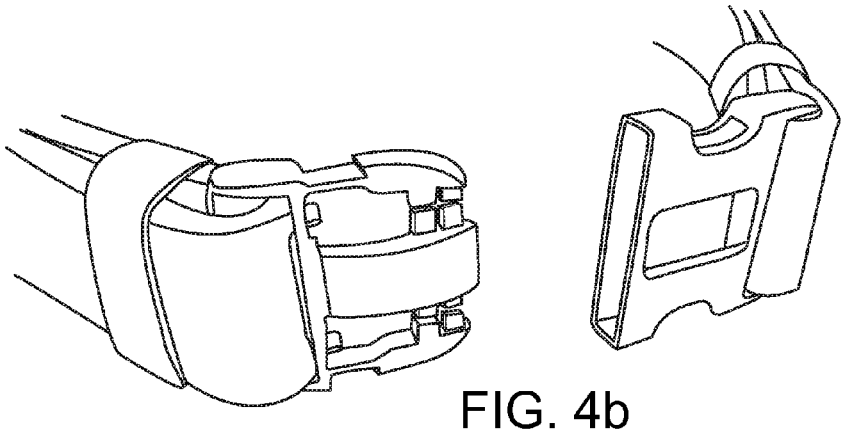
FIG. 4*b* shows an open duty belt.
Figure 4C:
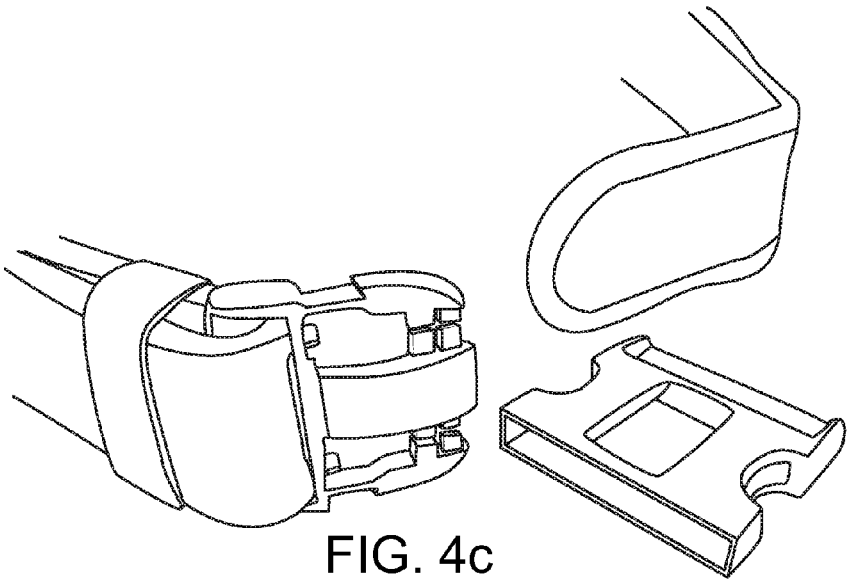
FIG. 4*c* shows a buckle removed on duty belt prior to sliding accessories on and off the belt.

The duty belts and buckles are executed in several different ways, each with their own pros and cons, as described below:

Some (FIG. 4*a*) utilize a Fastex type buckle that requires two steps in order to release. The version in FIG. 4*a* must have the center button pressed prior to squeezing the opposing buttons on either edge of the buckle. Even though there are only two steps, this is marketed as a 3-way retention, which is the standard and a positive selling feature in the market. The belt material itself threads through the Fastex buckle before it is attached back to itself, utilizing Velcro. Only the plastic buckle needs to be separated in order for the field professional to remove the duty belt (FIG. 4*b*). However, the connection between the belt and the buckle needs to be undone by the user, each time a new device is either threaded onto or off of the belt (FIG. 4*c*). The downsides of this assembly are:

The belt assembly is quite thick near the buckle as the belt is threaded through the buckle and folded back onto itself (~25 mm thick).

Belt accessories cannot be placed near the buckle because of interference with the folded-over-belt material.

In order to thread on belt accessories, the buckle is separated from the belt resulting in loose parts that can be dropped and lost.

The free slider that is used to retain the folded over at the end of the belt must first be removed, before accessories are put on. This results in more loose parts. It is also prone to errors for users who do not frequently reconfigure their belts.

The benefits of this buckle design are:

Even though it is 3-way retention, it only takes two motions to take the belt on and off.

Accessories can be threaded on and off, of either end of the belt.

Figure 5A:
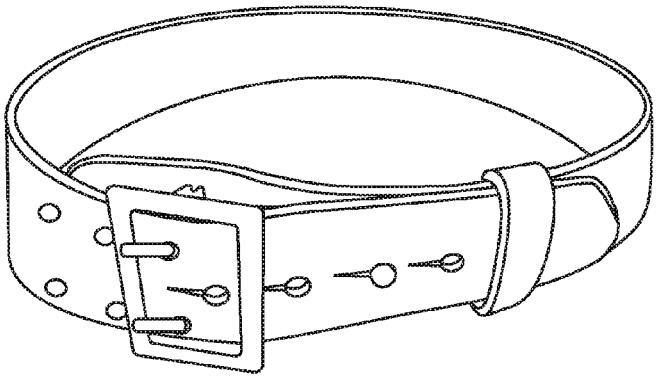
FIG. 5*a* shows a traditional buckle duty belt.
Figure 5B:
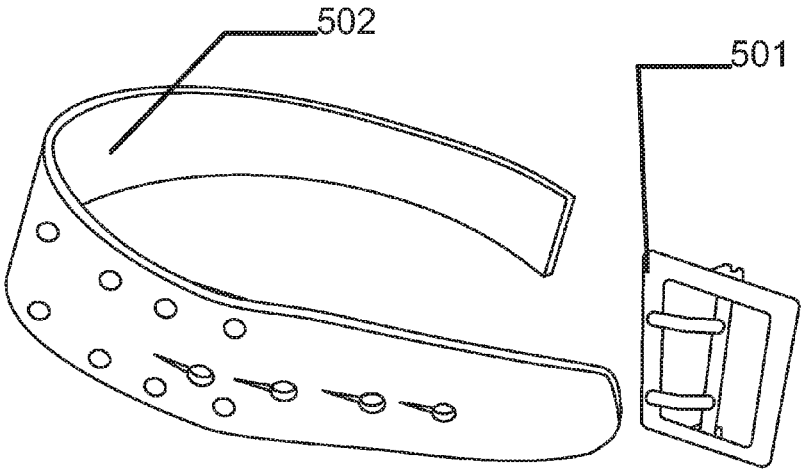
FIG. 5*b* shows a duty belt with removable buckle.
Figure 5C:
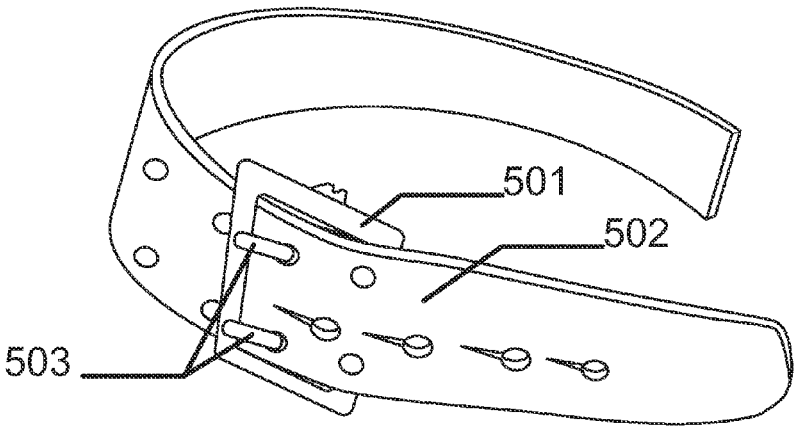
FIG. 5*c* is the Step 1 in assembling duty belt, as one example.
Figure 5D:
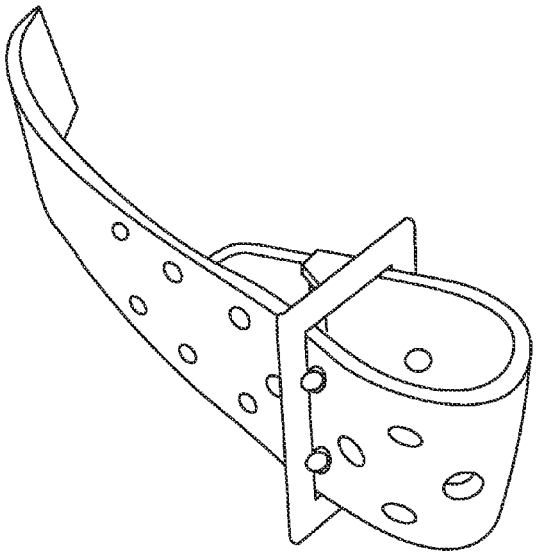
FIG. 5*d* is the Step 2 in assembling duty belt, as one example.
Figure 5E:
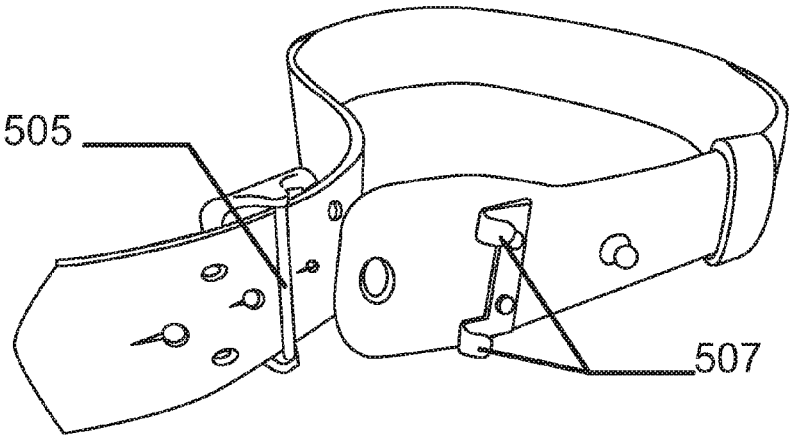
FIG. 5*e* is the Step 3 in assembling duty belt, as one example.
Figure 5F:
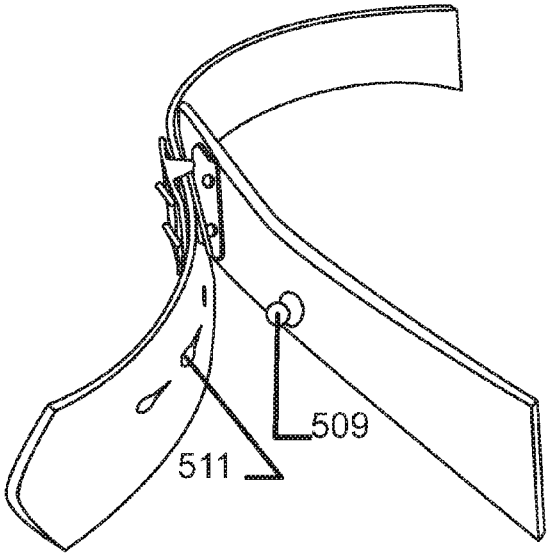
FIG. 5*f* shows another angle of step 3 in the assembly of the duty belt, as one example.
Figure 5G:
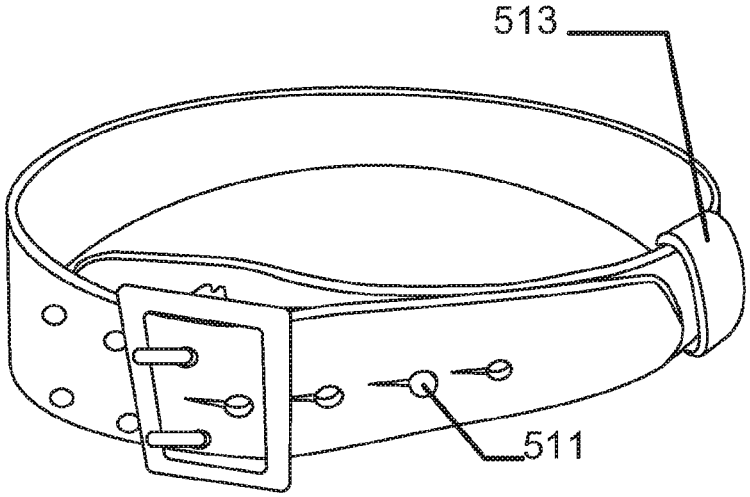
FIG. 5*g* shows the Step 4 in the assembly of the duty belt, as one example.
Figure 5H:
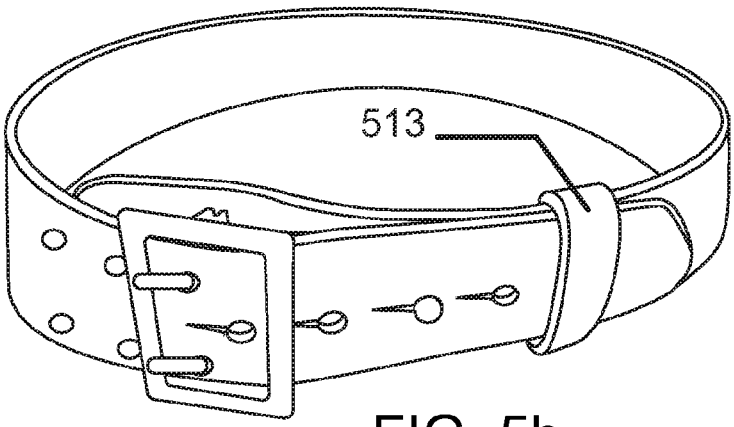
FIG. 5*h* shows the final step in assembly of the duty belt, as one example.

Another popular style of duty belt is shown in FIG. 5*a*. This also has a 3-way retention mechanism and, cosmetically, shows itself as a more traditional belt design with a buckle. The buckle itself is actually removable (FIG. 5*b*), and it is required to remove it, in order to thread on and off the belt accessories. In order to assemble the belt, the buckle is slid onto the belt (FIG. 5*c*), and the buckle's prongs engaged with the belt. Next, the end of the belt is threaded through the other half of the buckle (FIG. 5*d*). Now, the central bar on the buckle can engage with the prongs on the distal end of the belt (FIGS. 5*e* and 5*f*). To achieve the second level of retention, a stud which is integrated on the hook end of the belt is pressed through a hole on the buckle end of the belt (FIG. 5*g*). Finally, to get the third level of retention, a sliding keeper is moved over the free end of the belt (FIG. 5*h*).

The disadvantages of the belts described in FIGS. 5*a*-5*h* are:

There are many steps required in order to get the belt ready to slide on and off accessories, as the buckle needs to be removed.

Once removed, the buckle is a loose part, that may become lost.

Accessories may only be slid on and off, of one end of the belt, as the other end is too thick.

The belt assembly is thick beneath the buckle, when worn (~25 mm thick).

Advantages of this buckle design are:

Accessories may be placed close to the buckle on one side—the end of the belt with the buckle on it. The extending loose end of the belt prevents accessories being placed near the buckle on the other side of the buckle.

In its thickest part (under the buckle) it is similar in thickness to the Fastex belt, however, this thickness only occurs at one point where in the Fastex option, it occurs in two locations, one on either side of the buckle.

Since the sliding keeper is on the end of the belt, which does not have accessories sliding on and off, it does not have to be removed from the belt in order to configure the belt (as opposed to the Fastex version).

Figure 6:
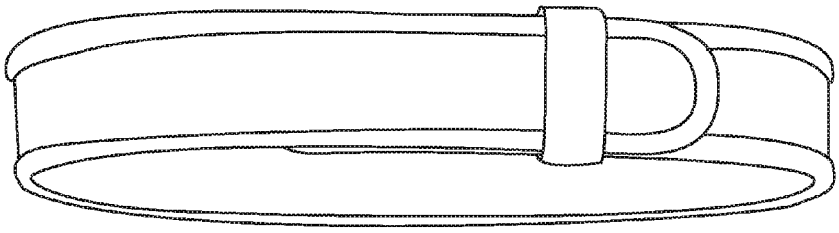
FIG. 6 shows a buckleless duty belt.

Another type of duty belt is a buckleless duty belt (FIG. 6). Other than cosmetics, this is equivalent in many ways to the belt detailed in FIGS. 5*a*-5*h*. Both have a free sliding keeper and a retaining stud. Instead of the hooks engaging with the back of the buckle, this version has Velcro between the two ends. Other buckleless belts have a sliding keeper, Velcro and a hidden metal hook and loop, in order to achieve three levels of retention.

The disadvantages of the buckleless belts are:

Accessories cannot be placed near the center front of the belt because of the overlapping belt.

Accessories can only slide on and off from one end of the belt because of interference with either the previously mentioned stud or the hidden hooks.

From a cosmetic standpoint, the buckleless designs are lacking a strong visual element of the buckle. Buckles live on the line of symmetry. The visual elements on the buckleless design live off-center.

Advantages of the buckleless design are:

It has the lowest profile of any of the existing systems.

There are no loose parts when sliding on and off accessories.

Figure 7:
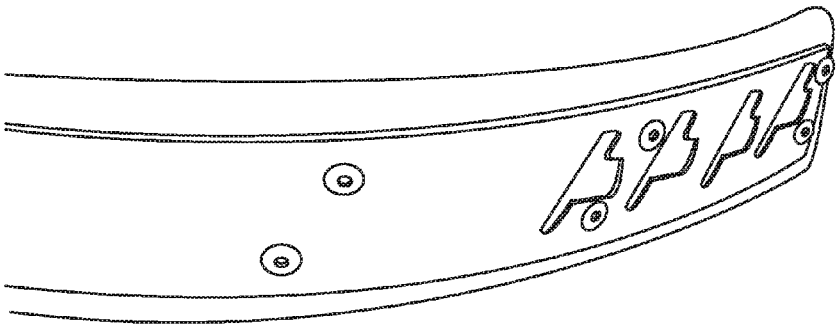
FIG. 7 shows an integrated rail on present invention, as an example.
Figure 8:
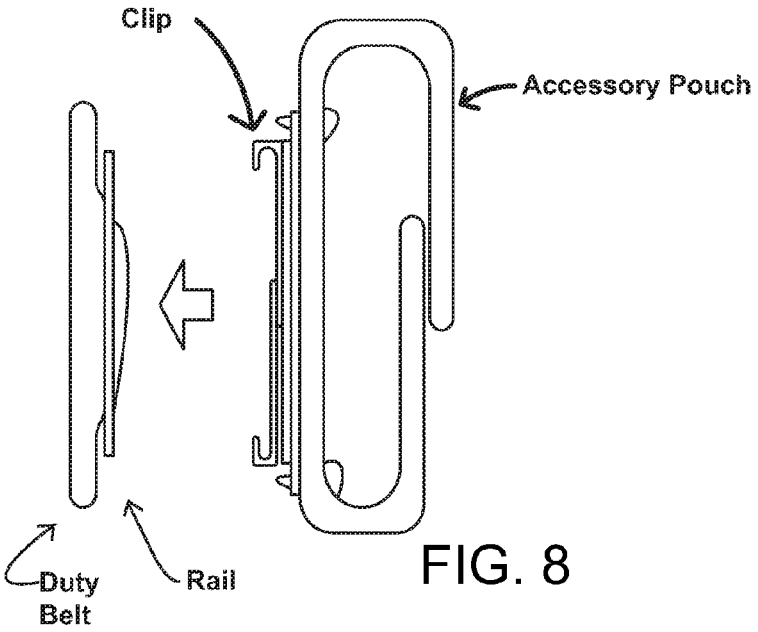
FIG. 8 shows a cross section view of duty belt and mounted accessory.
Figure 9A:
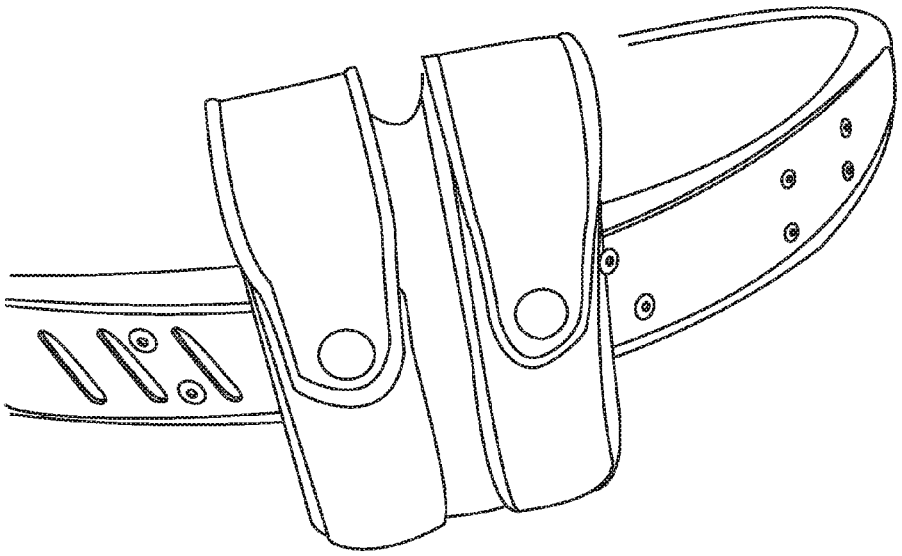
FIG. 9*a* shows a legacy accessory mounted to one of the current inventions (outside view).
Figure 9B:
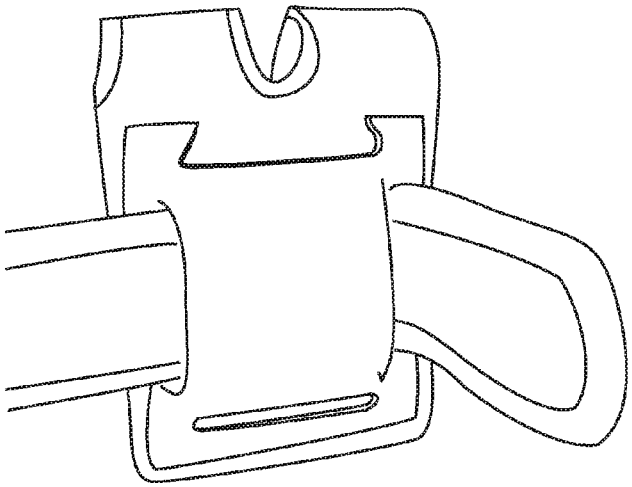
FIG. 9*b* shows legacy accessory mounted to current invention (inside view), as an example.

One embodiment of the current invention incorporates a rigid or semi-rigid rail mounted on the exterior of the duty belt (FIG. 7). The version shown is fabricated from thin sheet metal, but polymers could also be used. Instead of sliding accessories onto the belt from one of the ends, the accessories clip onto the rail (FIG. 8). Legacy accessories (those designed for the prior generation of duty belts) can still be utilized as they slide onto the belt in the traditional method (FIGS. 9*a* and 9*b*).

Figure 10:
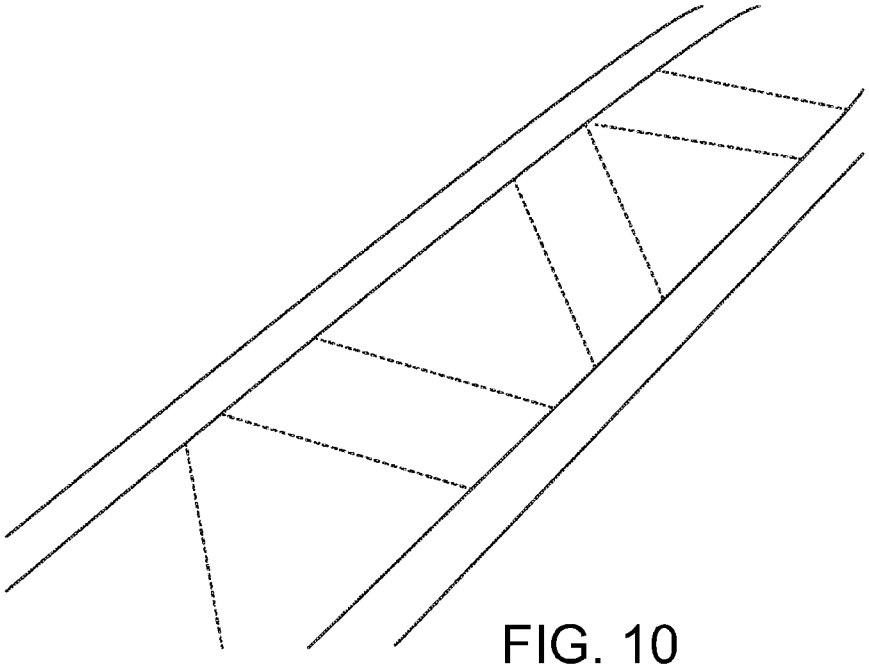
FIG. 10 shows the inside of a duty belt, as an example.

The inner surface of the duty belt can have either of the current state of the art surface treatments (½ of a Velcro (hook-and-loop fastener) assembly or no Velcro at all, with the intention of being retained by keepers only). It could also utilize a new surface treatment, as shown in FIG. 10. This has one half of the Velcro assembly, but only on a portion of the interior surface. This has two advantages. First it uses less Velcro, which is an expensive component. Secondly, where the Velcro is not present, mesh or perforations can be added to the belt in order to aide in breathability. The current belts are significantly wide (as previously mentioned) and made of impermeable materials. This combination can cause the users to sweat under the belt when worn for a prolonged period of time.

Figure 11:
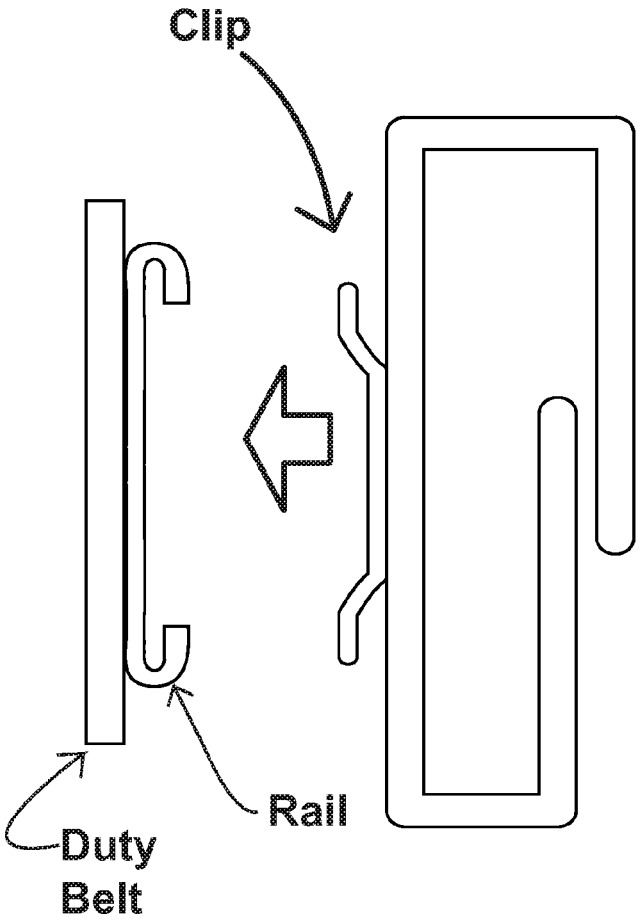
FIG. 11 shows an alternative rail configuration.
Figure 12:
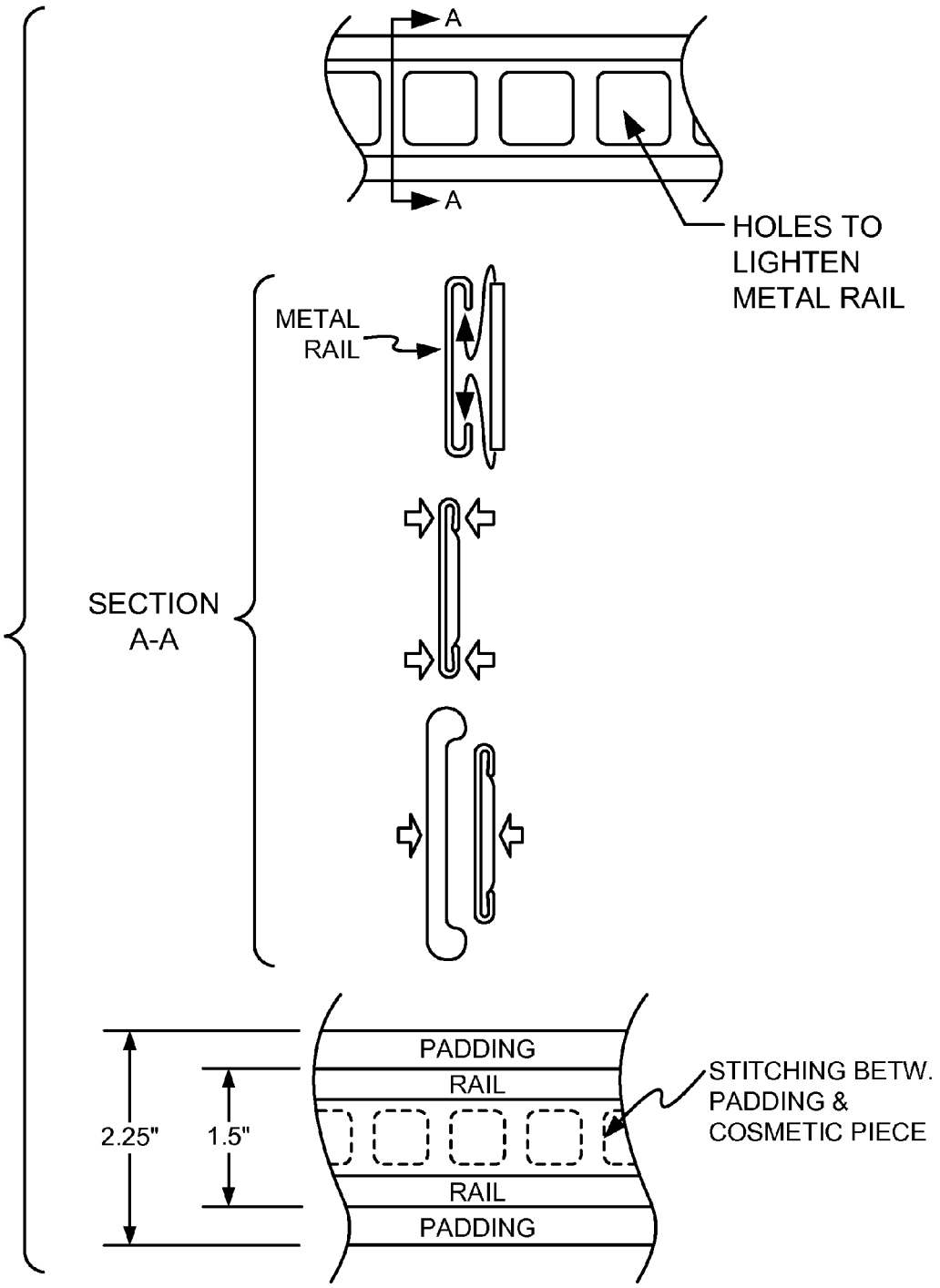
FIG. 12 shows a cosmetic piece attached in the interior of the rail.

In addition to a flat rail, the rail can be shaped. This can allow for alternative mounting techniques (FIG. 11). It also can allow for a cosmetic piece to be affixed on the interior of the rail (FIG. 12). Notice that the rail can be perforated to make it lighter and to aide in breathability. This cosmetic piece can also be extended and become integral with the ends of the belt (FIG. 13).

In the above description, the rail is shown to be continuous. It could also be interrupted to allow for several rails to be attached around the belt. In addition, it could also be segmented (FIG. 14). Both of these alternatives allow for a belt that is very easy to bend around the body. Belts like these can be shipped and displayed flat, as is for the current practice. (Note that FIG. 14 shows an articulating or segmented rail.)

Another alternative is that the rail is pre-formed prior to assembly (FIG. 15). In this manner, it can be shaped to fit a person. The advantage in this is that the load of the duty belt can be more evenly distributed around the user's waist.

The pre-formed rail can be taken a step further (FIG. 16) by not just curving it into a round cross section. The cross section of a person at the waist is not round and the rail (and therefore the duty belt as an assembly) can match the shape of an individual. An example of this is across the small part of the back of a person, where there is very little, if any, curvature. Another improvement is that the rail could have flaring (or even variable flaring) (also in FIG. 16), as the rail travels around the body. For example, across the pelvic bones, the lower edge of the rail (closer to the ground) could flare outward, while closer to the stomach the upper edge of the rail could flare outward.

Figure 17A:
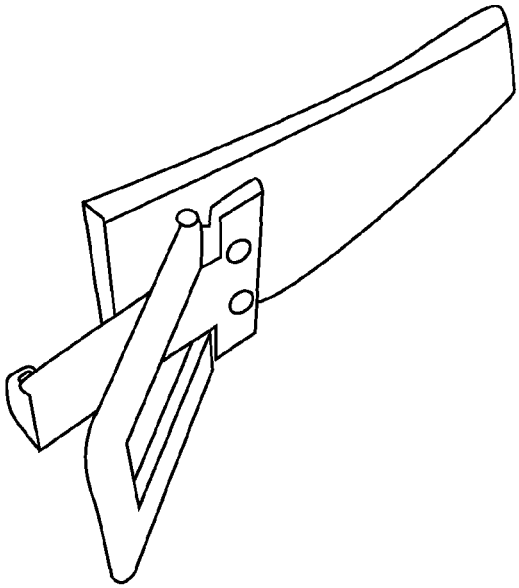
FIG. 17*a* shows an alternative buckle design.

With the rail, other buckle systems can be employed that are not possible with the current soft material belt. One of these utilizes a two part buckle (FIGS. 17*a* and 17*b*). The center portion of the buckle tabs into a perforation in the rail. The outer portion then pivots into place, preventing the center portion from backing out. A sliding keeper over the buckle would then represent the third layer of retention.

The above described embodiments can utilize any of the current state of the art buckles. In all of these, this invention has the distinct advantage when it comes to configuring the belt with accessories. Not only are there no loose parts during configuration, but the belt does not even have to be taken off the body. Plus, an accessory in the middle of the belt can be removed and replaced without disturbing any of the other accessories. And, since the rail can be taken right up to the buckle, accessories can be attached to the front of the belt, where it is impossible to attach them with the current solutions. This is especially striking with the buckleless system. In this, the rail can be taken right to the end of the belt, so that accessories can be mounted around the entire perimeter of the person. For some field professionals with a significant amount of accessories (e.g. law enforcement) and for some people with a small belt circumference, this is a striking advantage.

Figure 18:
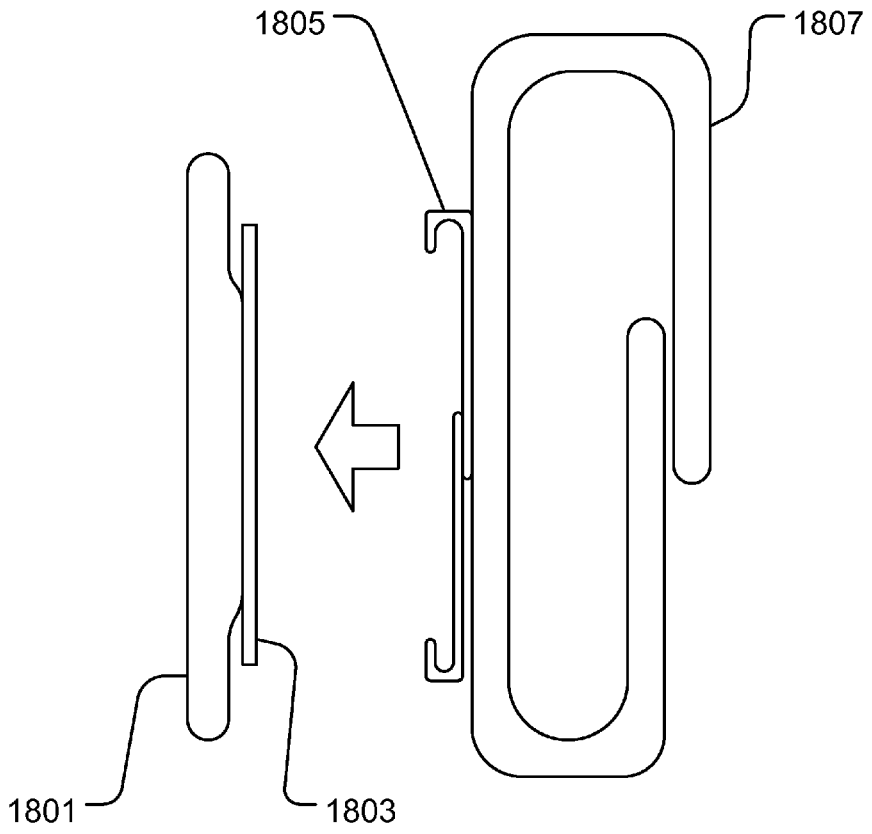
FIG. 18 shows a cross section view of duty belt and mounted accessory, similar to FIG. 8.

FIG. 18 shows a cross section of the belt assembly demonstrating the accessories clamping or attaching onto the edges of the rail, with the following components and features:

1801: duty belt

1803: rail

1805: clip

1807: accessory pouch.

FIG. 18 shows how they are put together (see the arrow).

Figure 19:
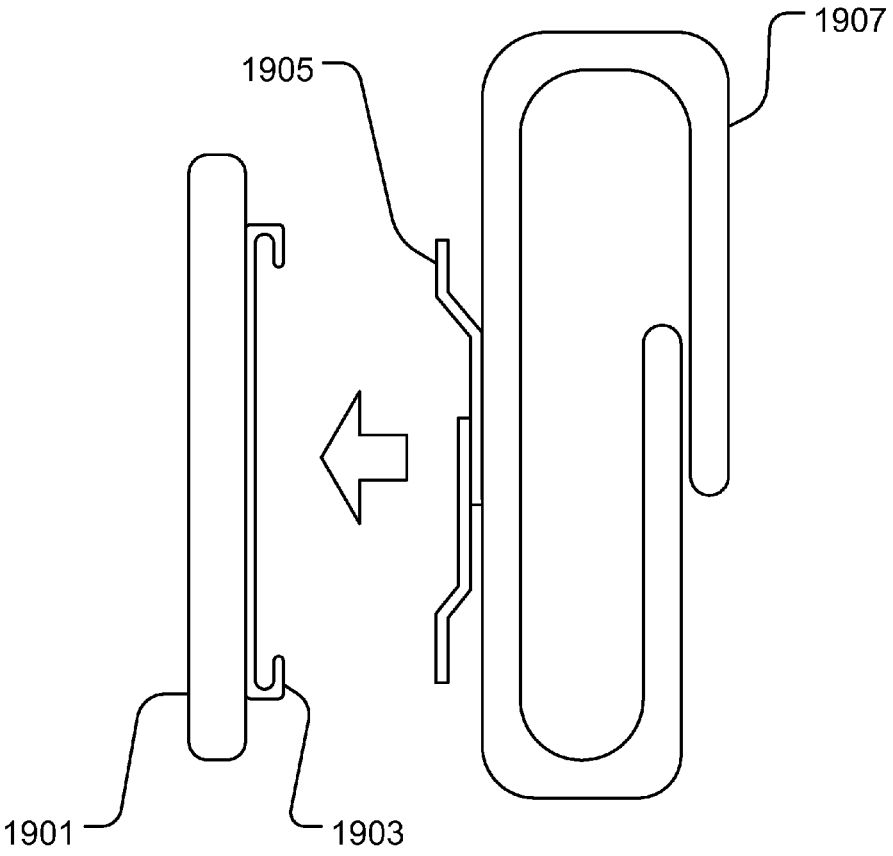
FIG. 19 shows an alternative rail configuration, similar to FIG. 11.

FIG. 19 shows a cross section of the belt assembly demonstrating an accessory attachment to the rail, in an embodiment, with the following components and features:

1901: duty belt

1903: rail

1905: clip. (Note that the two-part clip has a slight sliding movement, so that clip 1905 can fit and attach to the rail 1903. The same is shown in FIG. 18 above, for item 1805.)

1907: accessory pouch.

FIG. 19 shows how they are put together (see the arrow).

Figure 20A:
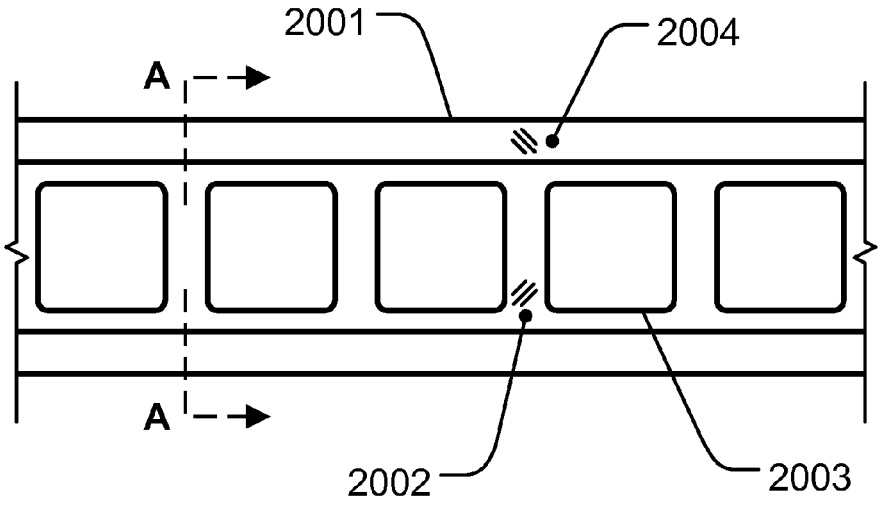
FIGS. 20*a-c* show a cosmetic piece attached in the interior of the rail, similar to FIG. 12.
Figure 20B:
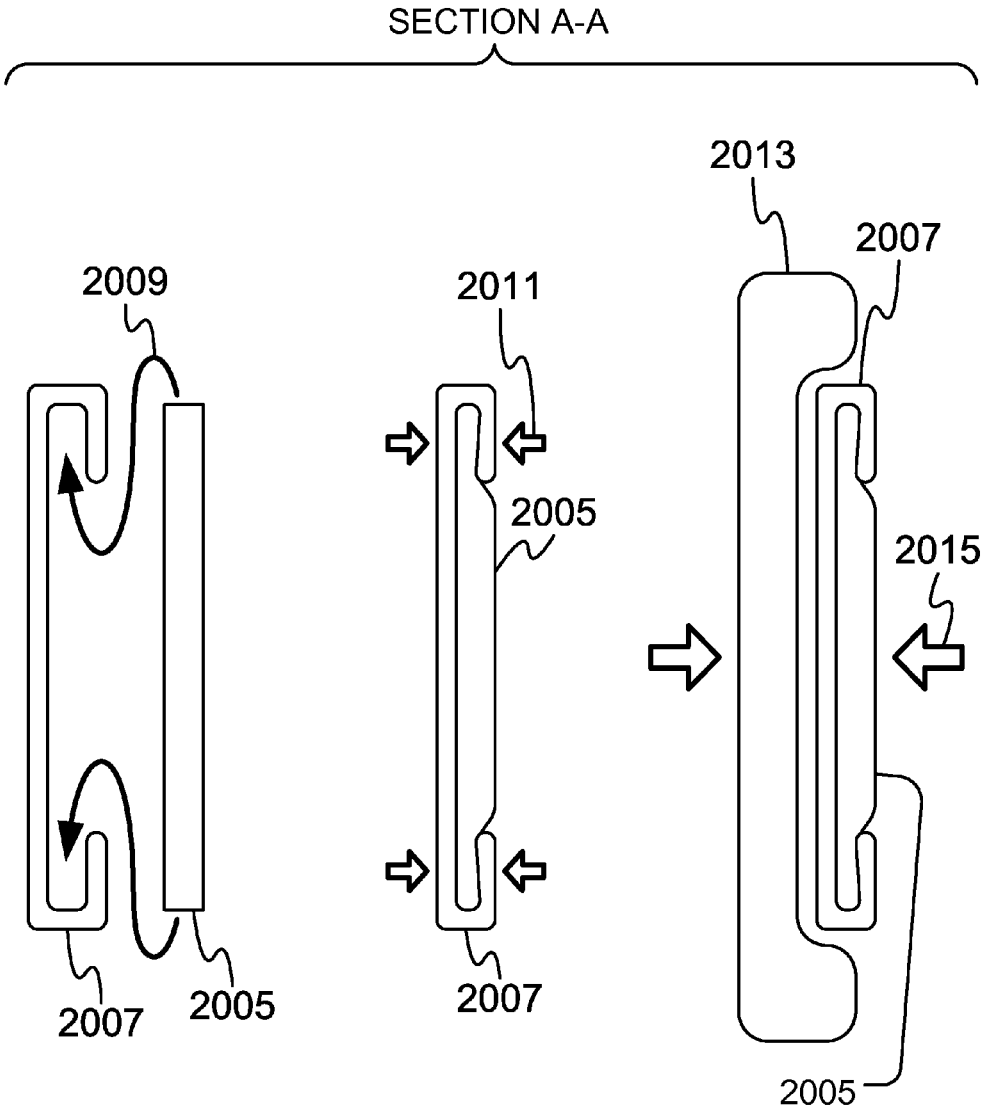
Figure 20C:
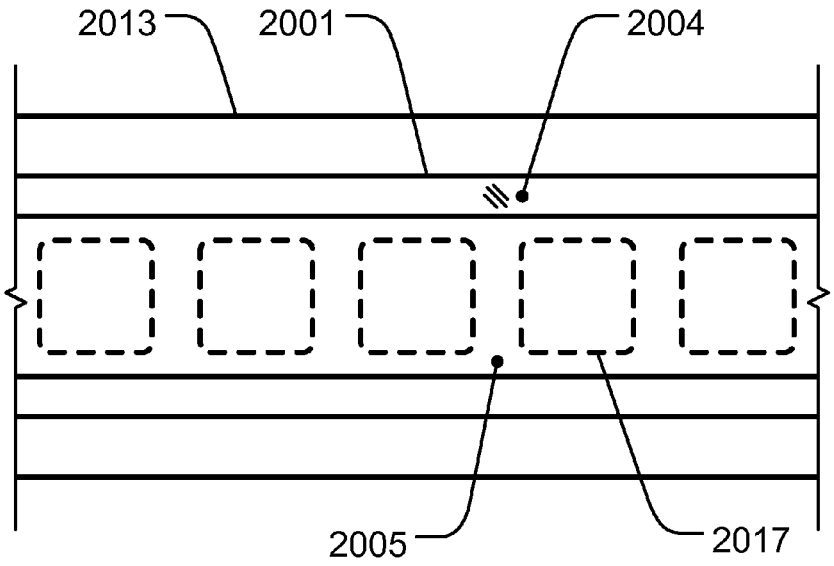

FIG. 20(*a*) shows the view of the rail with holes, e.g., to lighten the (e.g., metallic) rail, in an embodiment, with the following components and features (the view of the cross-section at A-A direction):

2001: rail

2002: surface of rail

2003: hole(s) in rail, e.g., to lighten the rail

2004: surface of rail bent over at top and bottom edges.

Please note that the width of the belt is defined as the perpendicular distance between the two letters A shown in FIG. 20(*a*).

FIG. 20(*b*) shows the cross section view of the rail with cosmetic and padding pieces, in an embodiment, with the following components and features:

2005: cosmetic piece (e.g., leather)

2007: rail (e.g., metallic)

2009: open hems allow for inserting cosmetic leather

2011: once cosmetic piece is inserted, hems can be finished off, to mechanically secure the edges of the leather.

2013: padding

2015: the padding is attached, e.g., by stitching between the padding and the cosmetic treatment through (e.g., large) rail holes.

FIG. 20(*b*) shows how they are put together (see the arrows, in the sequence, in the steps shown).

FIG. 20(*c*) is the view of the rail with cosmetic and padding pieces attached, in an embodiment, with the following components and features:

2001: rail (e.g., 1.5" wide)

2004: surface of rail, bent over at top and bottom edges, on cosmetic piece

2005: surface of cosmetic piece

2013: padding (e.g., 2.25" wide)

2017: stitching between padding and cosmetic piece, e.g., through holes in the rail.

Figure 21:
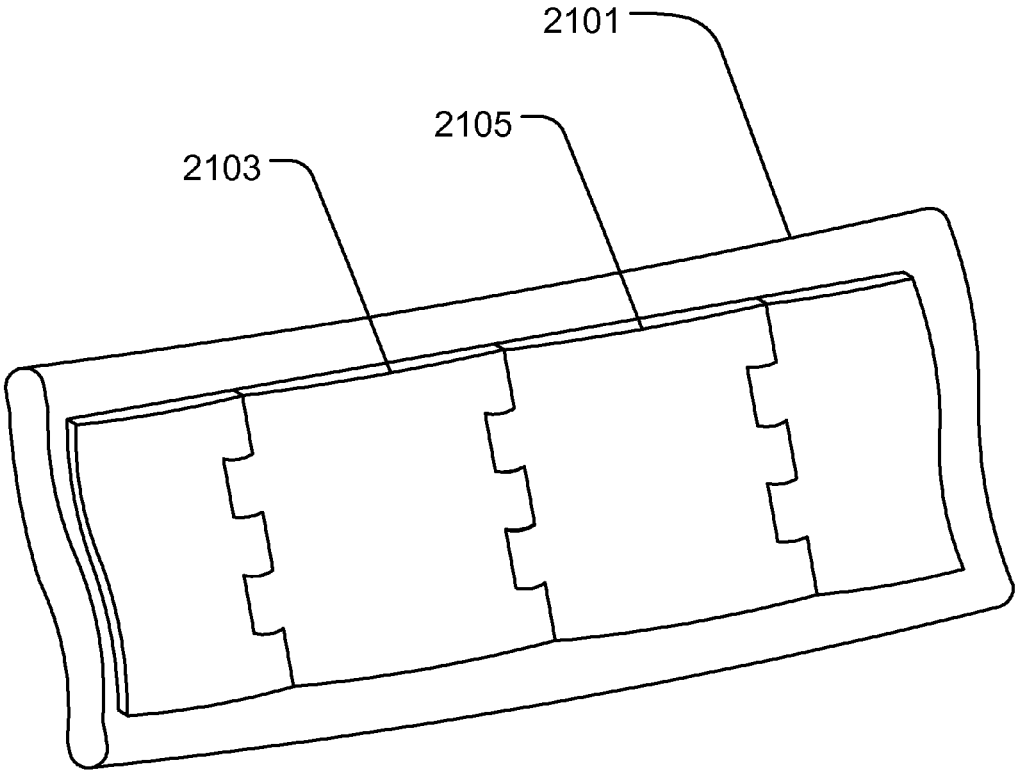
FIG. 21 shows a segmented rail, similar to FIG. 14.

FIG. 21 shows a section of duty belt, demonstrating segmented rail, in an embodiment, with the following components and features:

2101: padding

2103, 2105: rail segments.

Figure 22:
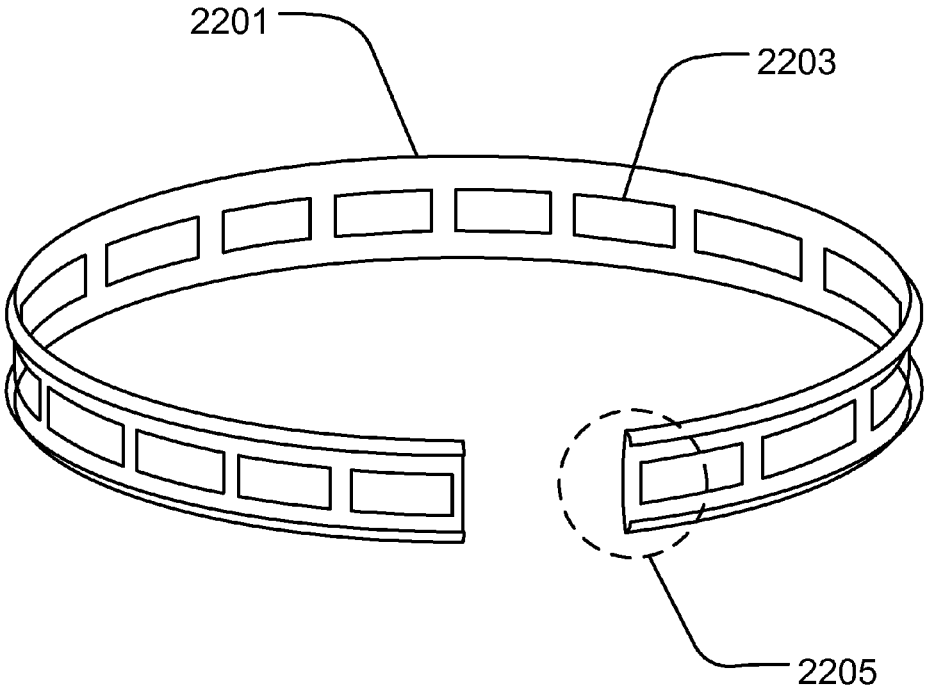
FIG. 22 shows a pre-formed rail, similar to FIG. 15.

FIG. 22 shows a view of the rail, pre-formed into shape, prior to assembly, in an embodiment, with the following components and features:

2201: rail

2203: e.g., hole(s) in the rail

2205: demonstrating top and/or bottom edge(s) of the rail, bent over.

With the rail preformed into shape, it has a less tendency to kink when putting it on, in one embodiment. This allows/demands unique Point of Purchase (or POP) display, which separates it from other types of belts. It also allows for marketing distinctions, e.g., "People are not flat, and thus, belts should not be." The form factor is comfortable and customizable for users of different size/shape. This is the first example of a platform where the rail is angled, as moving around the body.

Figure 23A:
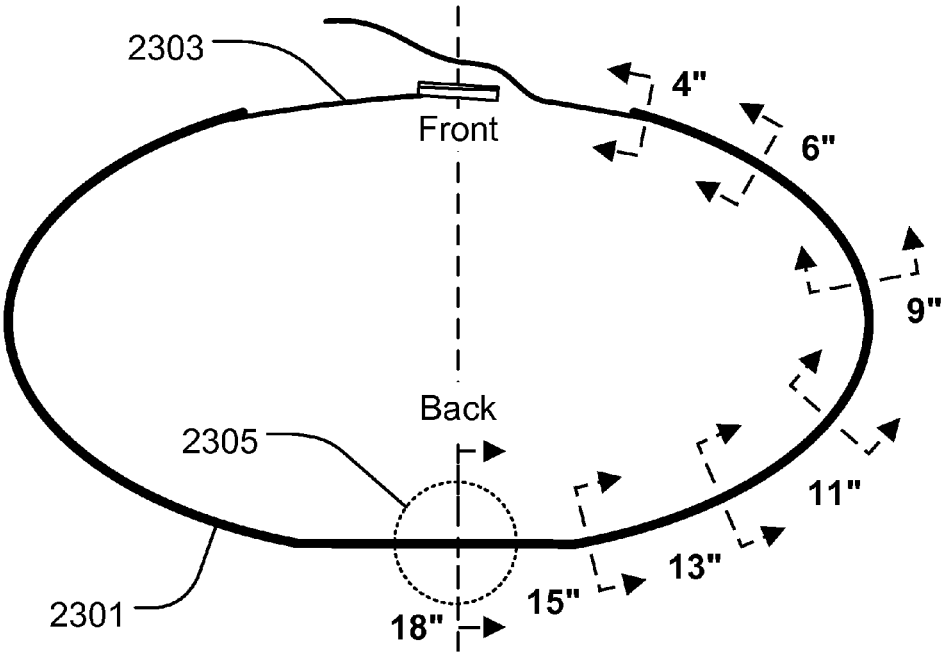
FIGS. 23*a-b* show a pre-formed rail with a variety of curvatures and flaring, similar to FIG. 16.
Figure 23B:
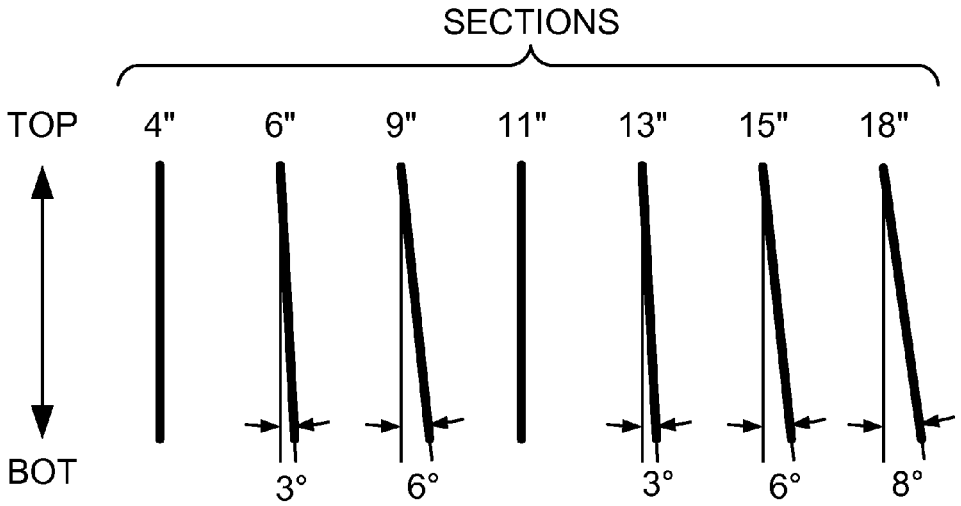

FIG. 23(*a*) is the top view of a pre-formed rail demonstrating various curvatures, in an embodiment, with the following components and features:

2301: rail

2303: e.g., strap and/or buckle in front region, instead of rail.

2305: e.g., small or no curvature at the back portion.

FIG. 23(*b*) shows the section view of a pre-formed rail demonstrating various flaring. In one embodiment, the bottom of the rail flairs out, to match the body contours. The flaring angles are provided as an example from a specific user (in an embodiment), taken at various locations, e.g., measured from the front, around to the back. In one embodiment, the padding also changes as it goes around the body, e.g., in order to spread out the hot spots (e.g., on pelvic bones). This configuration is very flexible and comfortable for the user.

Figure 24:
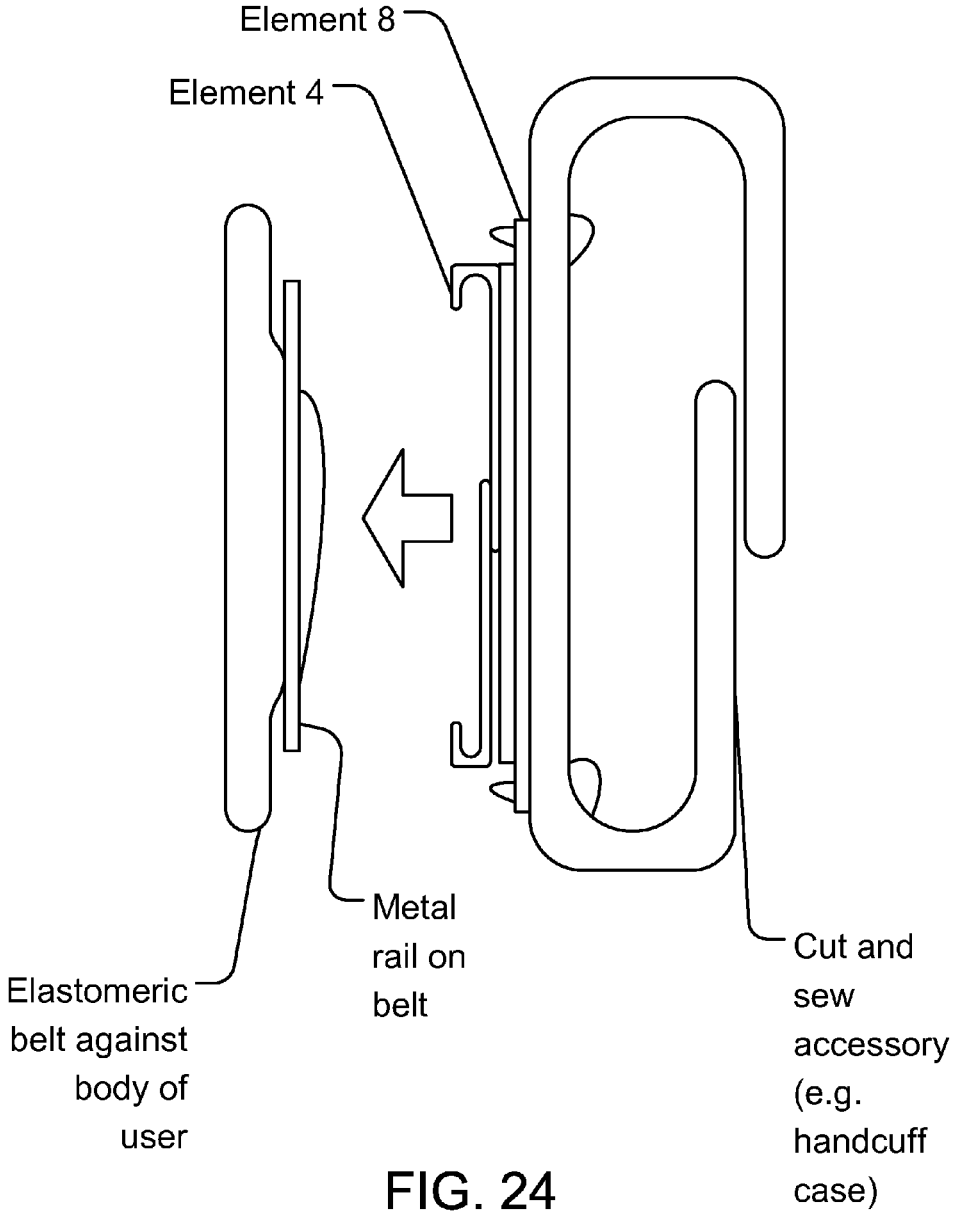
FIG. 24 shows an embodiment of the invention with elastomeric belt.
Figure 25:
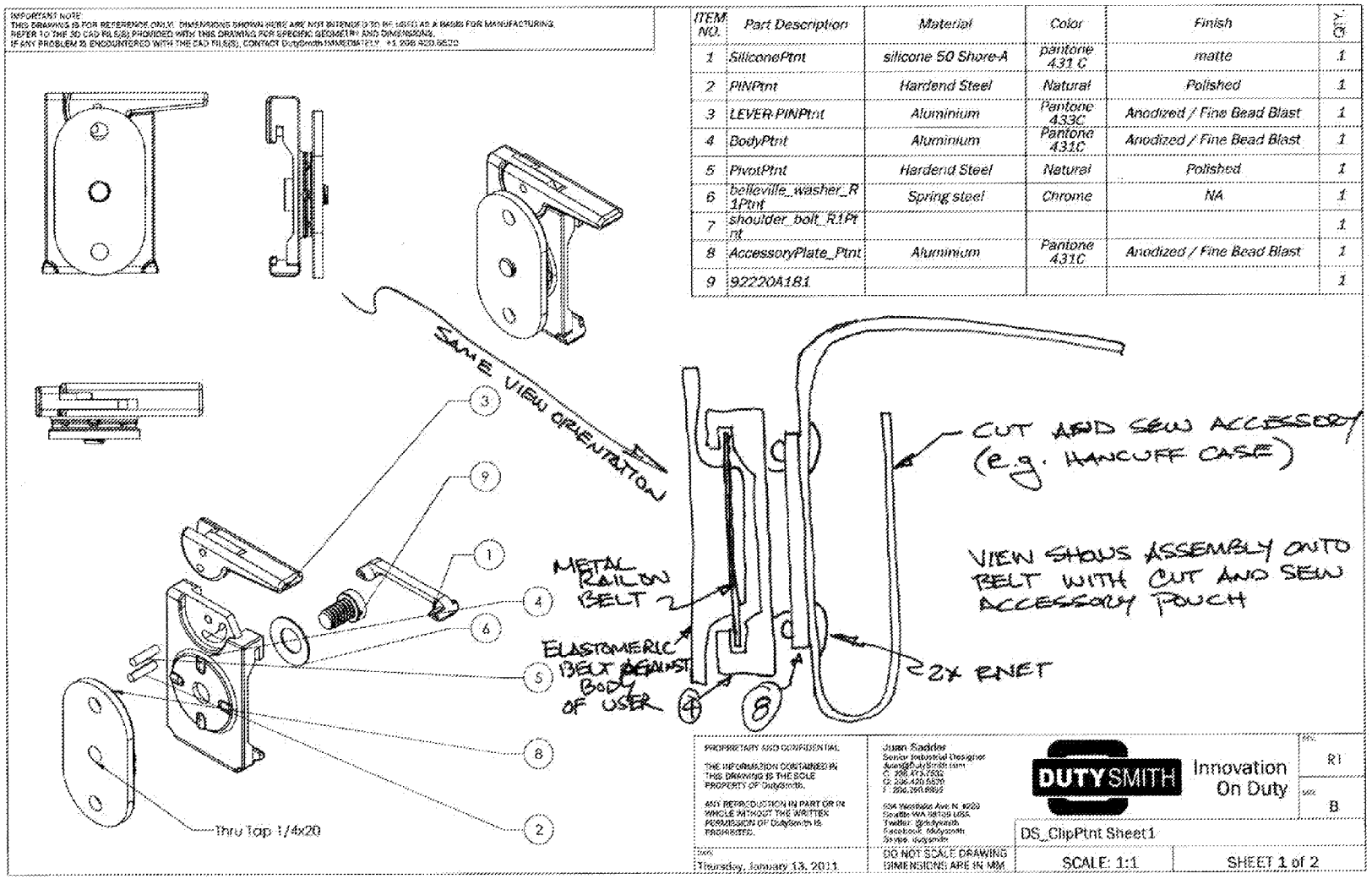
FIG. 25 shows an embodiment of the invention with elastomeric belt.
Figure 26:
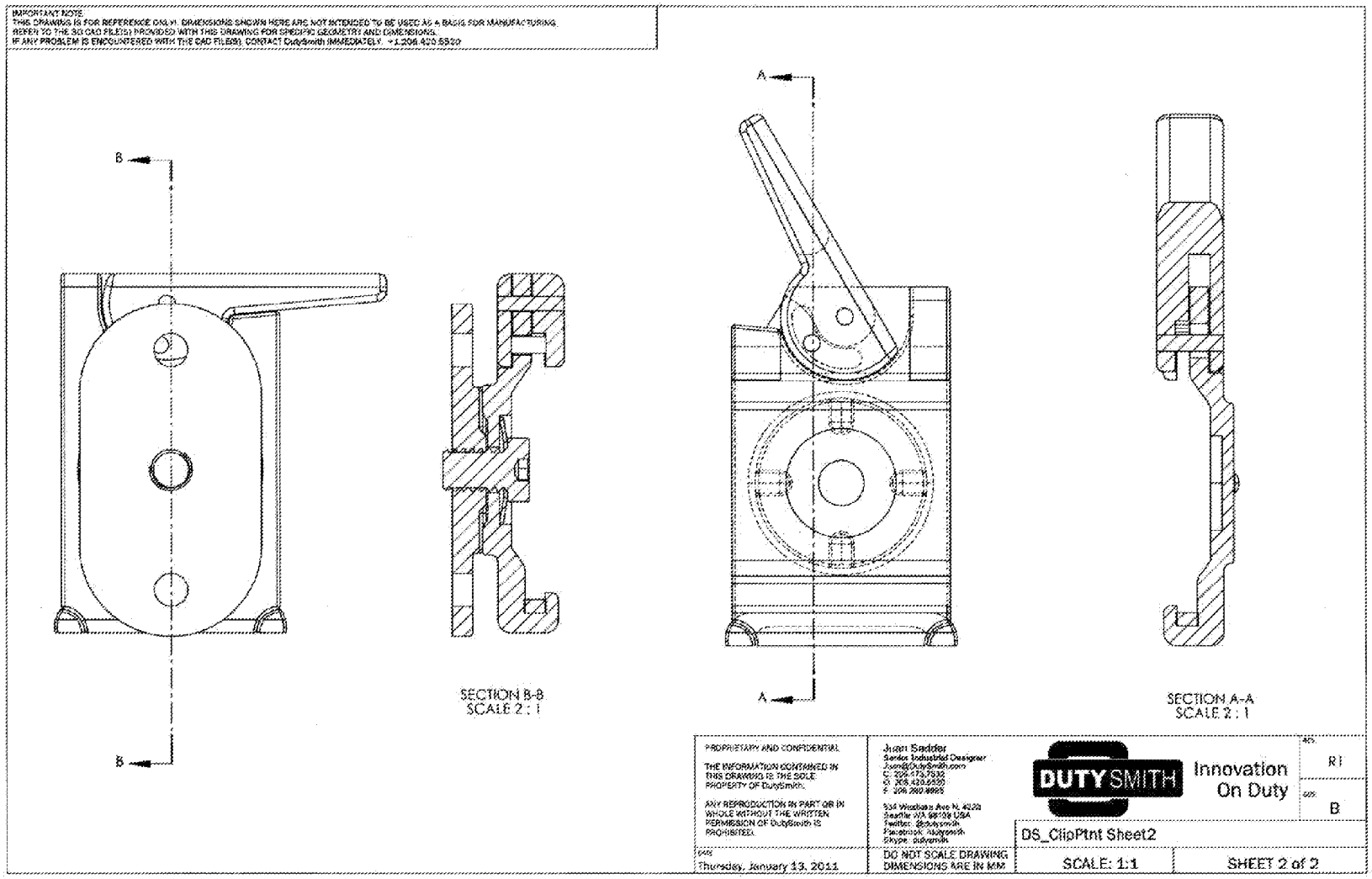
FIG. 26 shows an embodiment of the invention for details for FIG. 25.
Figure 27:
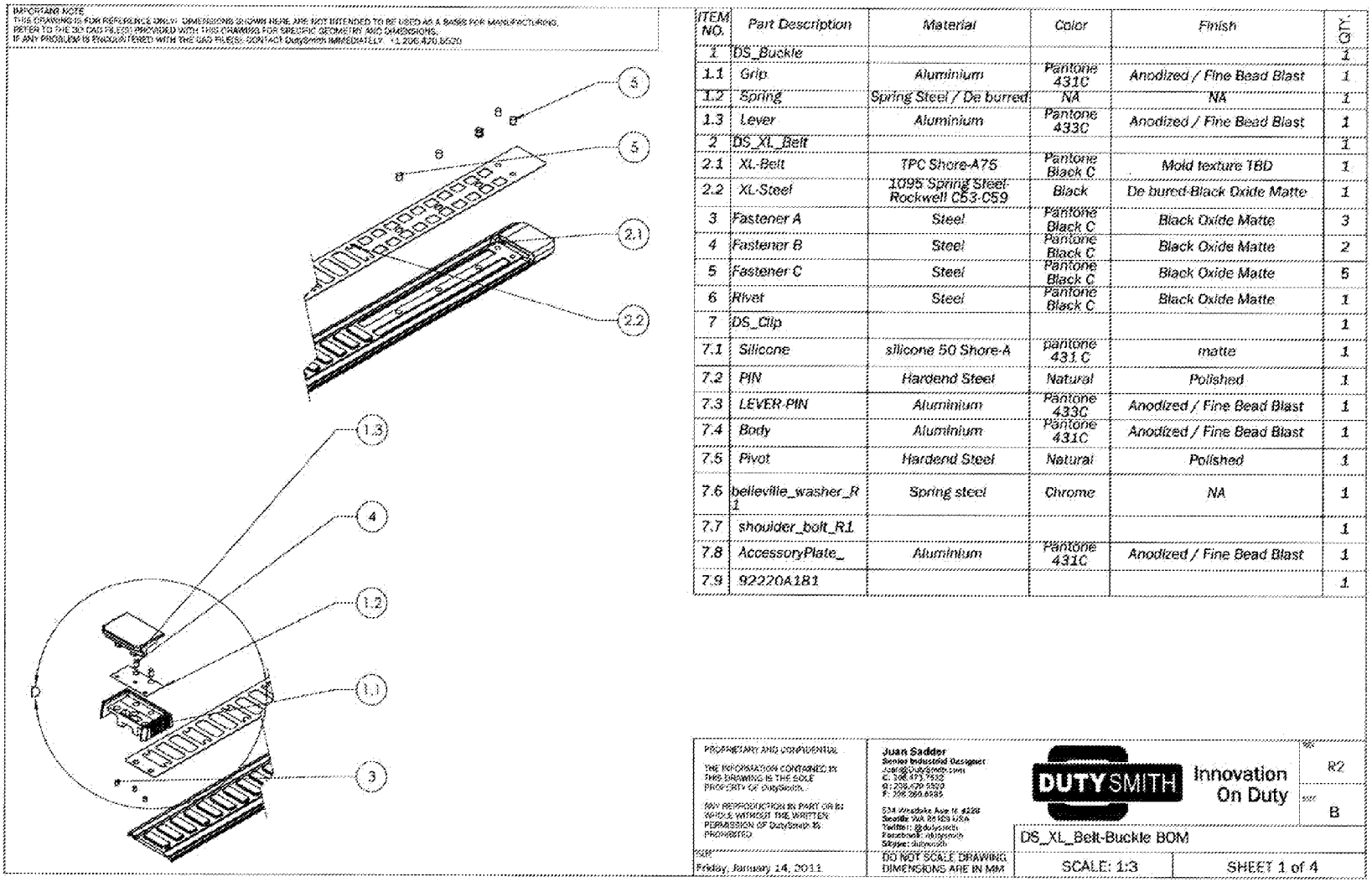
FIG. 27 shows an embodiment of the invention for details for FIG. 25.
Figure 28:
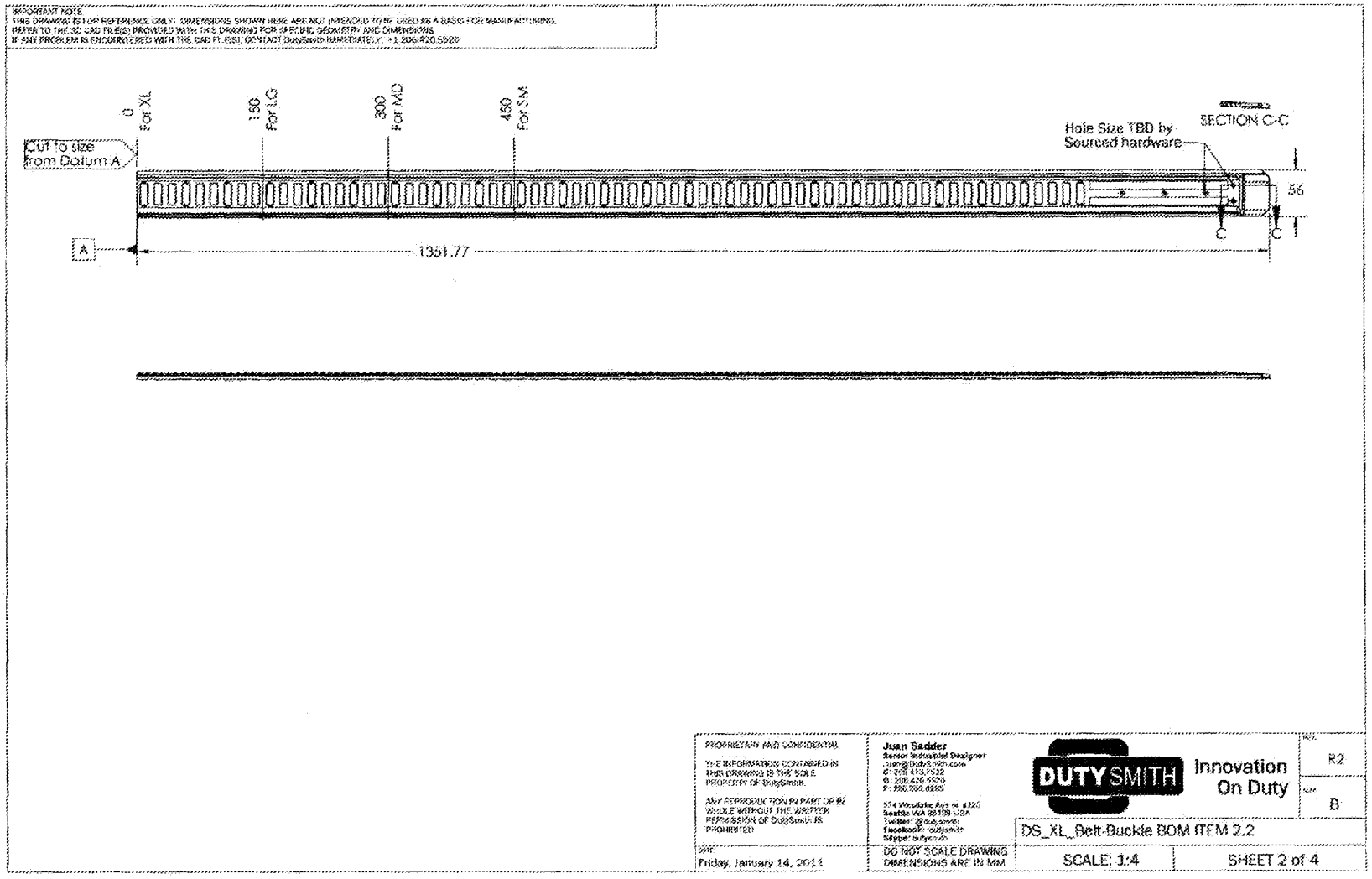
FIG. 28 shows an embodiment of the invention for details for FIG. 25.
Figure 29:
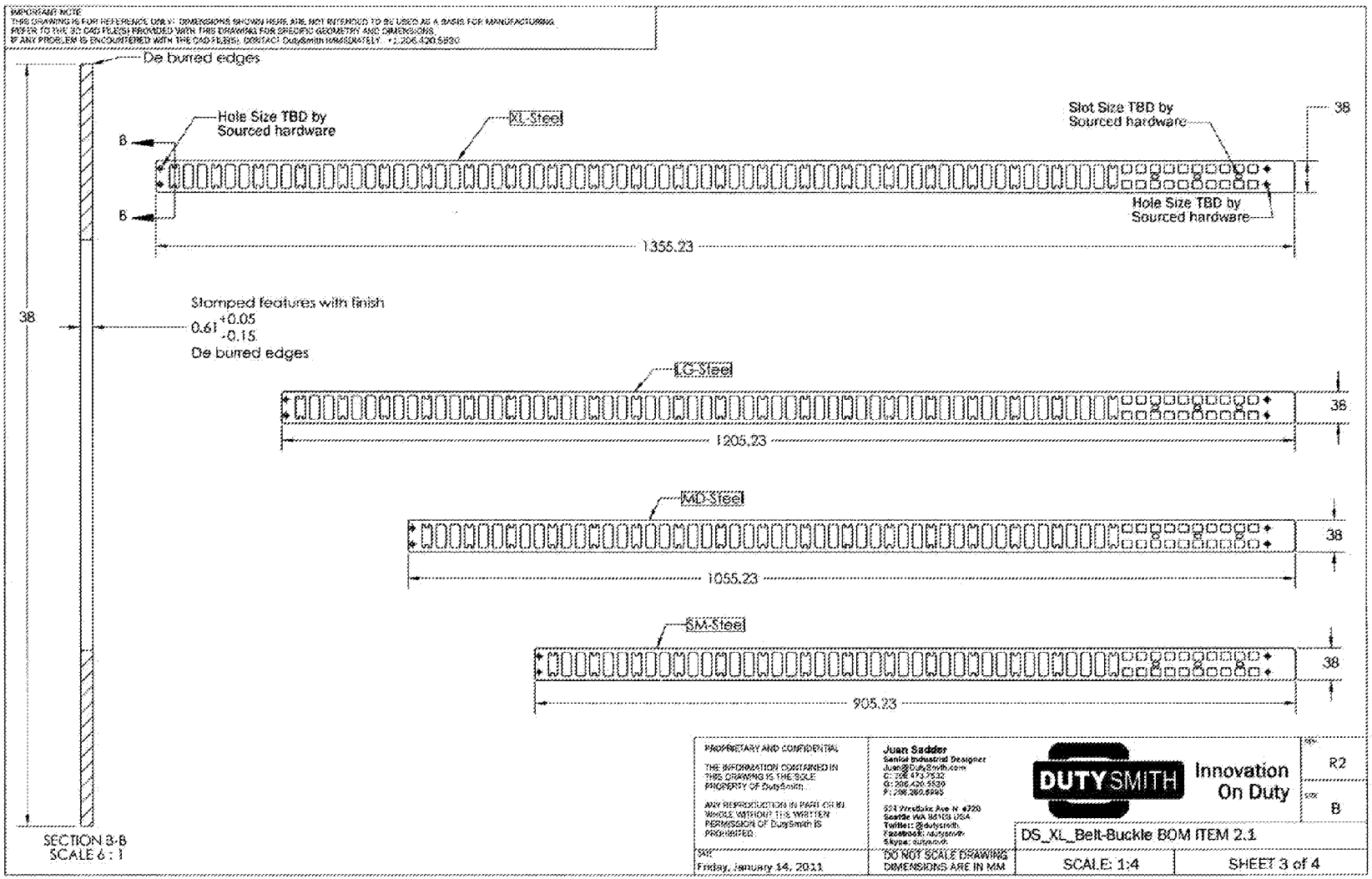
FIG. 29 shows an embodiment of the invention for details for FIG. 25.
Figure 30:
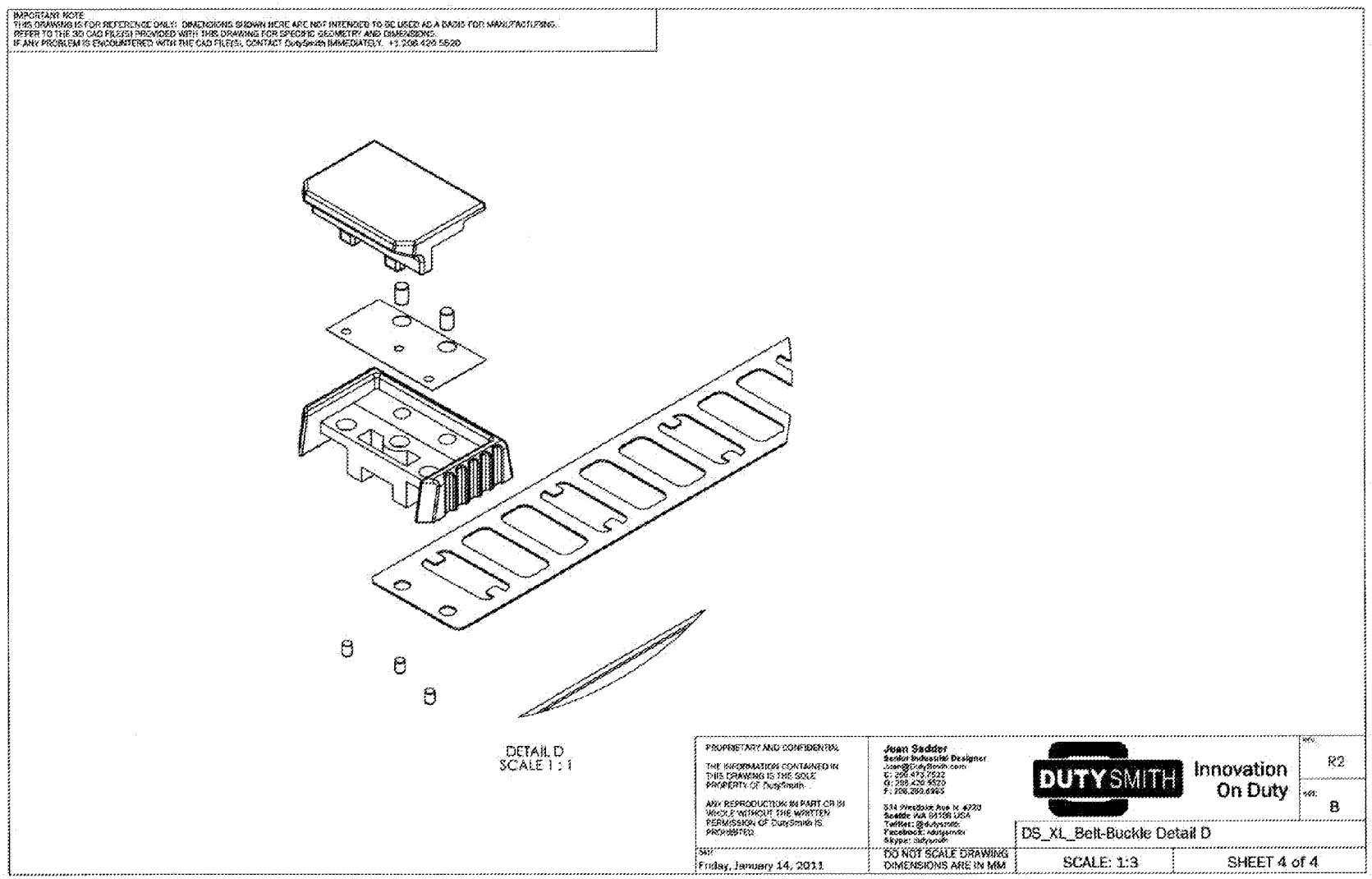
FIG. 30 shows an embodiment of the invention for details for FIG. 25.

Here is another embodiment: Referring to FIG. 24, we have an articulating clamp that grips around the edges of the rail. We are now showing in FIGS. 25-30 how the clamping of 1805 is accomplished (in FIG. 18)—by a lever with a pin that pushes on the edge of the rail. This is the focus on this embodiment.

One of the features of this embodiment is the vertical compliance of the system. Existing belts, if you squeeze them vertically, are very stiff. This is because the holsters wrap around the entire belt. In order to be secure and accommodate the load of the holsters and their items (e.g. sidearm), the existing belts are very stiff in the vertical dimension. When the belts are loaded up, or when the users sit down, these stiff belt edges dig into the user's legs, side, hips, or the like, causing discomfort for the users. Ours has a very rigid metal band which provides the vertical stability so it secures the items well. However, this band is narrower than the elastomer. So, the elastomer offers compliance before the compression is taken down to the metal band. Another way to describe this is that we have a variable stiffness curve in the vertical dimension. When force versus deflection is plotted, existing belts have a linear relationship between force and deflection vertically. Ours has a non-linear relationship. It starts out at one slope on the graph (representing softer and more compliant) and eventually gets to a different slope (representing stiffer and less compliant). In summary, our solution is strong, but yet flexible enough to make it easier for the user, when sitting with the belt on, as shown in FIG. 24 (with elements 4 and 8 referring to FIG. 25) and FIG. 25, with details in FIGS. 26-30.

For different embodiments, the components of the belt and/or buckle could be mechanically, thermally, sewn, pressed, heated, chemically, inset-molded, co-molded, glued, banded together, chained together, hooked, hook-and-looped, attached using Velcro, or otherwise, integrated or attached to each other, to the belt, or to the buckle. The components can be integrated as part of a belt or buckle. Or, it can be another piece, added to a belt or buckle, as a separate piece. The belt or buckle may have one or more layers or shells. The components may have a notch or lip(s), to attach to the belt or buckle. Or, one can use glue, screw, pin, small bar, or spring, to attach the components to the belt or buckle.

The material used for the belt or buckle can be selected from the following list (or their combinations): plastic, leather, silk, polyester, polymer, string, chain, elastic material, rubber, any artificial material, rigid, soft, flexible, wood, glass, smooth, rough, coarse material or surface, metal, alloy, nylon, cotton, wool, fabric, ceramic, porcelain, china, baked clay, cellulosic material, biomaterial, nano-material, composite, oil or petroleum product, artificial material, natural material, convex, concave, or flat surface, transparent, translucent, or opaque material, uniform, non-uniform surface, reflective surface, or absorptive surface.

Any variations of the above teaching are also intended to be covered by this patent application.

The invention claimed is:

1. A duty belt system, said duty belt system comprising:

an elastomeric or flexible belt, being flexible in a direction perpendicular to a length of said elastomeric or flexible belt; and one or more rigid, semi-rigid, or articulating rails attached on said elastomeric or flexible belt;

wherein said elastomeric or flexible belt is wider in said direction perpendicular to said length of said elastomeric or flexible belt than said one or more rigid, semi-rigid, or articulating rails; and wherein an accessory is attached to at least one of said one or more rigid, semi-rigid, or articulating rails at any point along said one or more rigid, semi-rigid, or articulating rails;

wherein said at least one of said one or more rigid, semi-rigid, or articulating rails comprises holes along a length of said at least one of said one or more rigid, semi-rigid, or articulating rails;

wherein said elastomeric or flexible belt faces a user's body, when worn by said user;

wherein parts of said elastomeric or flexible belt bulges out of said holes along said length of said at least one of said one or more rigid, semi-rigid, or articulating rails;

wherein said at least one of said one or more rigid, semi-rigid, or articulating rails is enveloped by a clip;

wherein said clip is attached to said accessory;

wherein said clip clamps to said at least one of said one or more rigid, semi-rigid, or articulating rails, by a lever that forces a pin into engagement with an edge of said at least one of said one or more rigid, semi-rigid, or articulating rails in order to prevent movement of said clip along said rail.

2. The duty belt system as recited in claim 1, said duty belt system comprising: a buckle.

3. The duty belt system as recited in claim 1, wherein material used for said duty belt system comprises: metal, fiber-epoxy composite, thermoset polymer or thermoplastic polymer.

4. The duty belt system as recited in claim 1, wherein material used for said duty belt system comprises: surface treated material with one half of a hook-and-loop fastener assembly.

5. The duty belt system as recited in claim 1, said duty belt system further comprises keepers.

6. The duty belt system as recited in claim 1, said duty belt system further comprises mesh or perforations.

7. The duty belt system as recited in claim 1, said duty belt system further comprises breathable material.

8. The duty belt system as recited in claim 1, wherein said duty belt system is pre-formed such that when it is in free, relaxed state, said duty belt system is non-planar.

9. The duty belt system as recited in claim 1, wherein a cosmetic piece is affixed to said duty belt system.

10. The duty belt system as recited in claim 1, wherein at least one part of said duty belt system is perforated.

11. The duty belt system as recited in claim 1, wherein a cosmetic piece is extended as an integral part of ends of said duty belt system.

12. The duty belt system as recited in claim 1, wherein said accessory is affixed to said one or more rigid, semi-rigid, or articulating rails with an over-center cam.

13. The duty belt system as recited in claim 1, wherein at least one part of said duty belt system has a cross section that matches curvature of a person's body.

14. The duty belt system as recited in claim 1, wherein at least one part of said duty belt system has flaring or variable flaring.

15. The duty belt system as recited in claim 1, wherein upper edge of said duty belt system has flaring outward, close to front of a user's body.

16. The duty belt system as recited in claim 1, wherein said more than one accessory includes an articulating clamp.

17. The duty belt system as recited in claim 1, said duty belt system further comprises a spring.

18. The duty belt system as recited in claim 1, wherein said more than one accessory is affixed to said one or more rigid, semi-rigid, or articulating rails with a bayonet mount.

19. The duty belt system as recited in claim 1, said duty belt system further comprises a pin.

20. The duty belt system as recited in claim 1, said duty belt system further comprises a lever-pin.

* * * * *